US009341995B2

(12) United States Patent
Aihara et al.

(10) Patent No.: US 9,341,995 B2
(45) Date of Patent: May 17, 2016

(54) TRANSFER APPARATUS AND TRANSFER METHOD

(71) Applicants: Yuichi Aihara, Yamanashi-ken (JP); Tetsuya Noda, Yamanashi-ken (JP)

(72) Inventors: Yuichi Aihara, Yamanashi-ken (JP); Tetsuya Noda, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/185,396

(22) Filed: Feb. 20, 2014

(65) Prior Publication Data

US 2014/0238252 A1 Aug. 28, 2014

(30) Foreign Application Priority Data

Feb. 22, 2013 (JP) ..... 2013-033862

(51) Int. Cl.
*G03G 15/00* (2006.01)
*G03G 15/16* (2006.01)

(52) U.S. Cl.
CPC .... *G03G 15/1695* (2013.01); *G03G 2215/1676* (2013.01); *Y10T 156/1705* (2015.01)

(58) Field of Classification Search
CPC ..... Y10T 156/1705; G03G 15/1695; G03G 2215/1676
USPC ..... 156/540; 101/217; 347/217
See application file for complete search history.

(56) References Cited

U.S. PATENT DOCUMENTS 5,446,527 A * 8/1995 Yasuda ..... G03G 15/1695 399/307
6,144,395 A * 11/2000 Sawano ..... B41J 2/38 347/187
2012/0286464 A1* 11/2012 Takei et al. ..... 271/4.01
2013/0251385 A1* 9/2013 Mitourida ..... 399/44
2014/0132697 A1* 5/2014 Sakai et al. ..... 347/217
2014/0139606 A1* 5/2014 Sakai et al. ..... 347/187

FOREIGN PATENT DOCUMENTS

JP 2006-142530 A 6/2006
WO WO2011/081128 * 7/2011 ..... B41J 13/00

* cited by examiner

*Primary Examiner* — Michael N Orlando
*Assistant Examiner* — John Blades
(74) *Attorney, Agent, or Firm* — Manabu Kanesaka

(57) ABSTRACT

To provide a transfer apparatus that uniforms peeling characteristics and peeling characteristics in transfer processing and that enables a stabilized transfer result to be obtained, in a transfer apparatus for nipping a transfer film 46 and recording medium K with a transfer roller 33 and transfer platen 31 to form an image on the recording medium, preheating treatment of the recording medium K is performed before transfer processing. At this point, by determining a preheating amount corresponding to the temperature of the recording medium K, it is possible to obtain a stabilized transfer result in response to a change in transfer conditions due to a change in environmental temperature and a change in the transfer surface. Particularly, in the case of performing backside transfer subsequently to frontside transfer, since the temperature of the recording medium K is high, a preheating amount in backside transfer is made smaller than in frontside transfer.

19 Claims, 19 Drawing Sheets

FIG. 15

| Environmental temperature | Preheating region | Preheating time |
|---|---|---|
| Extremely low temperature | Wide | Long |
| Low temperature | Only the front end portion | Short |
| Room temperature or more | Not preheated | Not preheated |

TRANSFER APPARATUS AND TRANSFER METHOD

TECHNICAL FIELD

The present invention relates to a transfer apparatus that transfers an image on a transfer film to a recording medium such as a card, and more particularly, to improvements in the transfer film peeling mechanism for peeling off a transfer film of which an image is transferred in an image transfer section from a recording medium.

BACKGROUND ART

Generally, this type of apparatus is widely known as an apparatus that forms an image such as a photograph of face and character information on a medium such as a plastic card. In this case, known are an apparatus configuration for directly forming an image on a recording medium and another apparatus configuration for forming an image on a transfer film and transferring the image to a recording medium.

In the case of such a transfer apparatus, since finish of transfer differs according to a temperature of an environment in which the apparatus is installed, it is necessary to vary transfer setting corresponding to the environmental temperature. For example, Patent Document 1 discloses a configuration for controlling a temperature of a heat roller that is a transfer member corresponding to the environmental temperature, and controlling driving of a cooling fan. More specifically, when the environmental temperature detected by an environmental temperature sensor falls below a reference value on the low-temperature side, a target temperature of a press roller (heat roller) is increased, and when the environmental temperature exceeds a reference temperature on the high-temperature side, a cooling fan is driven to supply cool air to a radiation region.

PRIOR ART DOCUMENT

Patent Document

[Patent Document 1] Japanese Patent Application Publication No. 2006-142530

DISCLOSURE OF INVENTION

Problems to be Solved by the Invention

In the configuration of Patent Document 1, control of the heat roller and cooling fan is performed according to the environmental temperature outside the apparatus, but in the case where the environmental temperature is extremely low and a recording medium such as a card is cold, only control of the heat roller does not allow the environmental temperature to be set at an appropriate temperature. Further, in the case where the environmental temperature is low but a temperature of a recording medium is high (for example, at the time of backside transfer subsequent to frontside transfer), when transfer operation set in a low-temperature environment is performed, such a possibility is high that transfer performance and peeling performance of a transfer film degrades.

Means for Solving the Problem

To attain an object as described above, in the present invention, a transfer apparatus for bringing a heating member and a transfer platen into press-contact with each other via a transfer film and transferring an image formed on the transfer film to a recording medium is characterized by being provided with an image transfer section, having the heating member and the transfer platen, configured to be able to shift between an actuation position in which the heating member and the transfer platen are brought into press-contact with each other and a retracted position in which the heating member and the transfer platen are separated, transfer film transport means for transporting the transfer film to the image transfer section, recording medium transport means for transporting a recording medium to the image transfer section, preheat means for performing heating treatment on the recording medium before image transfer processing by the image transfer section, and control means for determining a preheating amount on the recording medium by the preheat means, where the control means changes the preheating amount corresponding to a temperature of the recording medium.

Further, a transfer method of the present invention is a transfer method for bringing a heating member and a transfer platen into press-contact with each other via a transfer film and transferring an image formed on the transfer film to a recording medium in an image transfer section comprised of the heating member and the transfer platen, and is characterized by including a medium temperature detecting step of directly or indirectly detecting a temperature of the recording medium, a preheating amount determining step of determining a preheating amount to perform on the recording medium corresponding to the temperature of the medium detected in the medium temperature detecting step, a preheat step of performing preheating treatment on the recording medium corresponding to the preheating amount determined in the preheating amount determining step, and a transfer step of performing transfer processing on the recording medium.

Advantageous Effect of the Invention

The present invention has the preheat means for warming a recording medium before transfer processing, changes a preheating amount corresponding to the environmental temperature and a change in card temperature after one-side transfer in two-side printing, controls the card temperature in the transfer processing to within a certain range, thereby uniforms transfer characteristics and peeling characteristics in the transfer processing, and is capable of obtaining stabilized transfer results.

BRIEF DESCRIPTION OF DRAWINGS

FIG. 4A shows a state in which a transfer member, peeling member and support member are in actuation positions, and FIG. 4B is a state diagram in retracted positions;

FIG. 8A is an entire perspective view, and FIG. 8B is an up-and-down mechanism view of the peeling member in FIG. 7;

FIG. 15 is a diagram illustrating criteria of card preheating and details of preheating;

MODE FOR CARRYING OUT THE INVENTION

Figure 1:
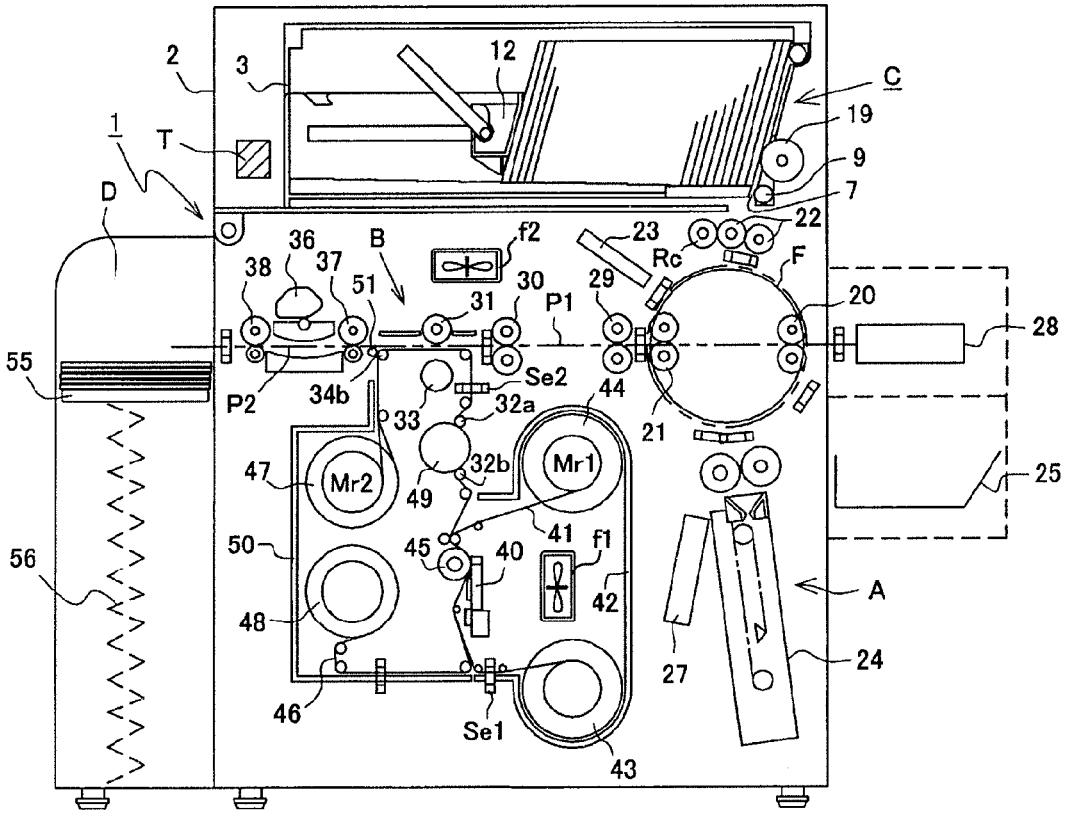
FIG. 1 is an entire configuration explanatory view of an information recording apparatus according to the present invention.

The present invention will specifically be described below based on a preferred Embodiment shown in the figures. FIG. 1 is an explanatory view of an entire configuration of an information recording apparatus according to the invention. The apparatus as shown in FIG. 1 records image information on ID cards for various kinds of identification, credit cards for business transactions and the like. Therefore, the apparatus is provided with an information recording section A, image recording section (image formation section; the same in the following description) B and a card supply section C that supplies cards to the sections.

[Card Supply Section]

The card supply section C is provided in an apparatus housing 1, and is comprised of a card cassette that stores a plurality of cards. The card cassette 3 as shown in FIG. 1 aligns and stores a plurality of cards in a standing posture, and cards are fed from the left end to the right end as viewed in the figure. Then, a separation opening 7 is provided at the front end of the card cassette 3, and cards are supplied into the apparatus by a pickup roller 19 starting with the card in the front row.

[Configuration of the Information Recording Section]

The card K (recording medium; the same the following description) fed from the card cassette 3 as described above is fed to a reverse unit F from carry-in rollers 22. The reverse unit F is comprised of a unit frame bearing-supported by an apparatus frame (not shown) to be turnable, and a pair or a plurality of pairs of rollers supported on the frame.

In the apparatus as shown in the figure, two roller pairs 20, 21 disposed at a distance at the front and back are axially supported by the unit frame to be rotatable. Then, the unit frame turns in a predetermined-angle direction by a turn motor (pulse motor or the like), and the roller pairs attached to the frame are configured to rotate in forward and backward directions by a transport motor. This driving mechanism is not shown, and may be configured so that one pulse motor switches between turning of the unit frame and rotation of the roller pairs with a clutch, or different driving may be configured for turning of the unit frame and rotation of the roller pairs.

Accordingly, cards prepared in the card cassette 3 are separated on a card-by-card basis by the pickup roller 19 and separation roller (idle roller) 9 to be fed to the reverse unit F on the downstream side. Then, the reverse unit F carries the card in the unit by the roller pairs 20, 21, and changes the posture in the predetermined-angle direction with the card nipped by the roller pairs.

Around the reverse unit F in the turn direction are disposed a magnetic recording unit 24, non-contact type IC recording unit 23, contact type IC recording unit 27, and reject stacker 25. In addition, "28" shown in the figure denotes a barcode reader, and is a unit to read a barcode printed in the image formation section B, described later, for example, to verify (error check). Hereinafter, these recording units are referred to as data recording units.

Then, when the card that is posture-changed in the predetermined-angle direction in the reverse unit F is carried to the recording unit by the roller pairs 20, 21, it is possible to input data to the card magnetically or electrically. Further, when a recording mistake occurs in the data input units, the card is carried out to the reject stacker 25.

The image formation section B is provided on the downstream side of the reverse unit F, a carry-in path P1 for carrying the card from the card cassette 3 to the image formation section B is provided, and the reverse unit F as described previously is disposed in the path P1. Further, in the carry-in path P1 are disposed transport rollers (that may be belts) 29, 30 that transport the card, and the rollers are coupled to a transport motor (stepping motor) not shown. The transport rollers 29, 30 are configured to enable switching between forward rotation and backward rotation, and transport the card from the image formation section B to the reverse unit F in a similar manner to transporting the card from the reverse unit F to the image formation section B.

On the downstream side of the image formation section B is provided a carrying-out path P2 for carrying the card to a storage stacker 55. In the carrying-out path P2 are disposed transport rollers (that may be belts) 37, 38 that transport the card, and the rollers are coupled to the transport motor (stepping motor) as described above.

In addition, a decurl mechanism 36 is disposed in between the transport roller 37 and the transport roller 38, presses the card center portion held between the transport rollers 37, 38, and thereby corrects curl. Therefore, the decurl mechanism 36 is configured to be able to shift to positions in the vertical direction as viewed in FIG. 1 by an up-and-down mechanism (cam or the like) not shown.

[Image Formation Section]

The image formation section B forms images such as a photograph of face and character data on the frontside and backside of the card. The image formation section B is provided with a transfer platen 31, and forms the image on the card surface on the platen. In the apparatus as shown in the figure, the image is formed on a transfer film 46 (intermediate transfer film), and the image on the film is transferred to the card surface on the transfer platen 31. Therefore, the apparatus housing 1 is installed with an ink ribbon cassette 42 and a transfer film cassette 50.

The ink ribbon cassette 42 as shown in the figure is installed in the apparatus housing 1 to be attachable and detachable with a thermal transfer ink ribbon 41 such as a sublimation ink ribbon and others wound between a feed roll 43 and a wind roll 44. The wind roll 44 is coupled to a wind motor (DC motor) Mr1 not shown, and the feed roll 43 is also coupled to a DC motor similarly. Further, on the apparatus side are disposed a thermal head 40 and an image formation platen 45 with the ink ribbon 41 therebetween.

An IC 74*a* for head control (see FIG. 11) is coupled to the thermal head 40 to thermally control the thermal head 40. The IC 74*a* for head control heats and controls the thermal head 40 according to image data, and thereby forms an image on the transfer film 46, described later, with the ink ribbon 41. Therefore, it is configured that the wind roll 44 rotates in synchronization with thermal control of the thermal head 40 to wind the ink ribbon 41 at a predetermined velocity. "f1" shown in the figure denotes a cooling fan to cool the thermal head 40.

Meanwhile, the transfer film cassette 50 (hereinafter, referred to as a "film cassette") is also installed in the apparatus housing 1 to be attachable and detachable. The transfer film 46 loaded in the film cassette 50 travels between the platen roller (image formation platen) 45 and the ink ribbon 41, and an image is formed on the transfer film. Therefore, the transfer film 46 is wound around a supply spool 47 and a wind spool 48, and carries the image formed on the image formation platen 45 into between the transfer platen 31 and the transfer roller 33 described later. "49" shown in the figure denotes a carry roller of the transfer film 46, pinch rollers 32*a*, 32*b* are disposed on the periphery of the carry roller, and the roller is coupled to a drive motor (stepping motor) not shown. Further, the supply spool 47 is coupled to a DC motor Mr2 not shown, and the wind spool 48 is also coupled to a DC motor not shown similarly.

Further, "34*a*" shown in the figure denotes a guide roller that guides the transfer film 46 to the transfer platen 31, and "34*b*" shown in the figure denotes a peeling roller (peeling member; the same in the following description) that peels off the transfer platen 31 from the recording medium. The guide roller 34*a* and the peeling roller 34*b* are attached to the film cassette 50, and are respectively positioned on the upstream side and downstream side with the transfer platen 31 therebetween. Then, a support pin 51 (support member; the same in the following description) that supports the transfer surface side of the card is provided immediately on the downstream side of the peeling roller in the card transport direction of the transfer processing time. The support pin 51 is provided in a bracket 69 that supports the peeling pin 34*b*, and the peeling pin 34*b* and support pin 51 maintain the certain position relationship. Further, a distance L1 between the guide roller 34*a* and the peeling roller 34*b* is set to be shorter than the length Lc of the card K in the image formation direction (transport direction) (L1<Lc).

The transfer roller 33 is disposed opposite the transfer platen 31 with the transfer film 46 therebetween. The transfer roller 33 heats and comes into press-contact with the image formed on the transfer film 46 to transfer to the card. Therefore, the transfer roller 33 is comprised of a heat roller, and is provided with transfer member up-and-down means 61, described later, to come into press-contact with and separate from the transfer platen 31 from inside the film cassette 50. The transfer platen 31 is driven by the same stepping motor as that for the transport rollers 29, 30, 37 and 38, and performs transfer processing while transporting the card K (and the intermediate transfer film 46) with the card K and intermediate transfer film 46 nipped by the platen 31 and the transfer roller 33. In addition, "Se1" shown in the figure denotes a position detecting sensor of the ink ribbon 41, "Se2" shown in the figure denotes a sensor for detecting the presence or absence of the transfer film 46, and a fan f2 to remove heat generated inside the apparatus to the outside is provided in the image formation section B. Thus, the unit for forming an image on the intermediate transfer film 46 using the thermal head 40 is referred to as a first transfer section, and the unit for transferring the image formed on the intermediate transfer film 46 in the first transfer section to the card K is referred to as a second transfer section.

A card storage section D is provided on the downstream side of the image formation section B, and cards fed from the transfer platen 31 are stored in the storage stacker 55. The storage stacker 55 is configured to be lowered corresponding to the card storage amount with an up-and-down mechanism 56 and a level sensor not shown.

[Configuration of the Film Cassette]

Figure 2:
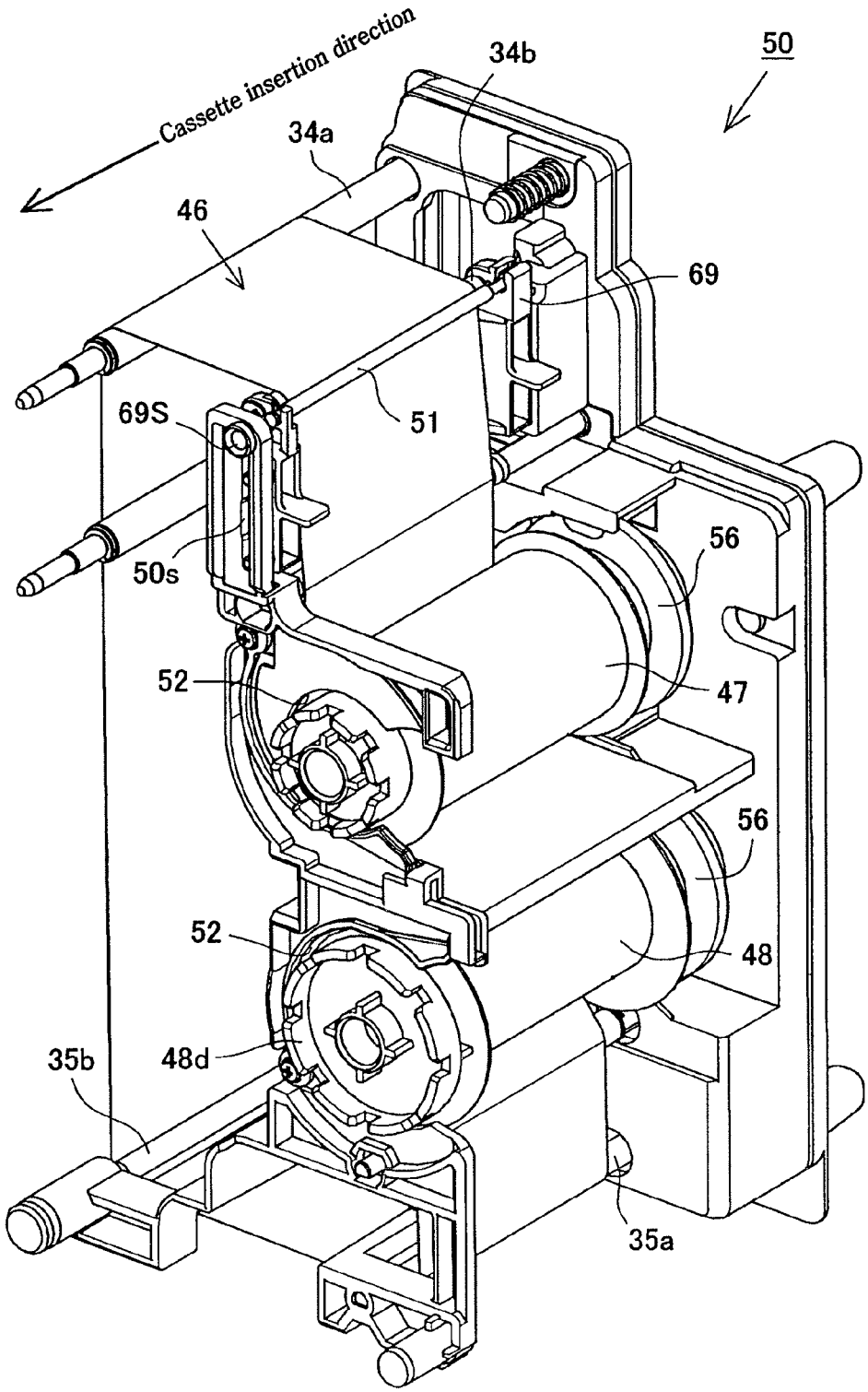
FIG. 2 is a perspective view of a film cassette in the apparatus of FIG. 1.

Described is the film cassette 50 loaded with the transfer film 46 as described above. As shown in FIG. 2, the film cassette 50 is made of a unit separated from the apparatus housing 1, and is attached to the apparatus housing 1 to be attachable and detachable. Although not shown in the figure, a front cover is disposed to be openable and closable on the front side in FIG. 1, and the film cassette 50 is inserted in the apparatus frame in the arrow direction in FIG. 2 with the front cover opened.

The film cassette 50 is installed with the supply spool 47 and the wind spool 48 to be attachable and detachable. "52" shown in the figure is a bearing portion that supports one end of the spool, and "56" shown in figure is a coupling member that supports the other end side of the spool. The spool end portions are supported by the bearing portion 52 and coupling member 56 disposed on the cassette side. Then, the transfer film 46 is laid from the supply spool 47 to guide rollers 34*a*, 35*b*, 35*a* and the wind spool 48 through the peeling roller 34*b*.

In addition, the guide rollers 35*a*, 35*b*, 34*a* and the peeling roller 34*b* (peeling member; the same in the following description) shown in the figure are formed from pin members (driven rollers) attached to the film cassette 50, and the rollers may be fixed pins (non-rotation). In the apparatus, in transferring the image on the transfer film 46 to the card, transfer is performed while winding the transfer film 46 by the supply spool 47. Accordingly, the peeling roller 34*b* is provided on the downstream side (on the side closer to the supply spool 47 than the heat roller 33) in the film transport direction in transfer of the transfer film 46.

The peeling roller 34*b* is fixed to the bracket 69, and the bracket 69 is provided with the support pin 51. The transfer film 46 travels between the peeling roller 34*b* and the support pin 51, and therefore, in replacing the transfer film 46, it is configured that the support pin 51 is separated from the peeling roller 34*b* with the film cassette 50 removed from the apparatus housing 1.

Figure 3:
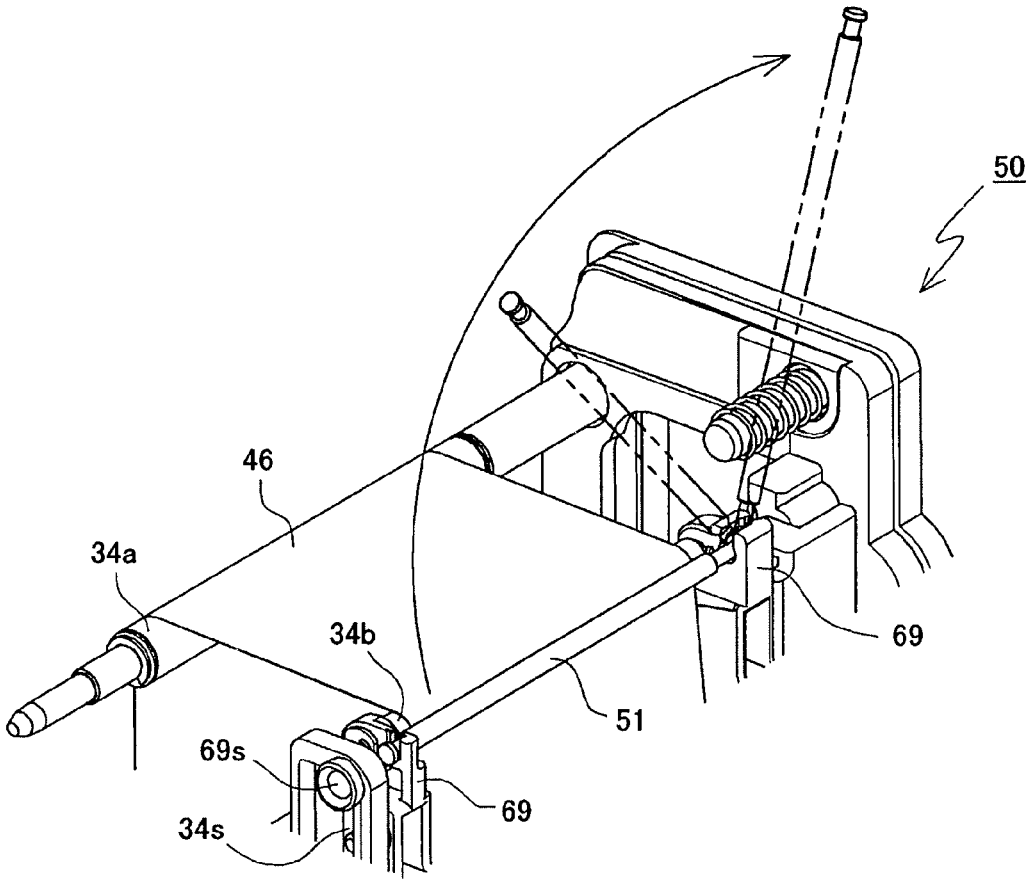
FIG. 3 is an enlarged view of a support member in the film cassette of the FIG. 2.

As shown in FIG. 3, one end 51*a* of the support pin is fitted into the bracket 69 to be attachable and detachable, the other end 51*b* is pivotably supported by a concave portion of the bracket 69, and therefore, the support pin 51 is configured to be able to pivot in the dashed-line arrow direction. Accordingly, the support pin 51 is able to shift (pivot) to a set position (solid line) and a release position (dashed line). A user removes the film cassette 50 from the apparatus housing 1, replaces the transfer film 46 with the support pin 51 shifted to the release position, and after returning the support pin 51 to the set position, loads the film cassette 50 into the apparatus housing 1.

Figure 4A:
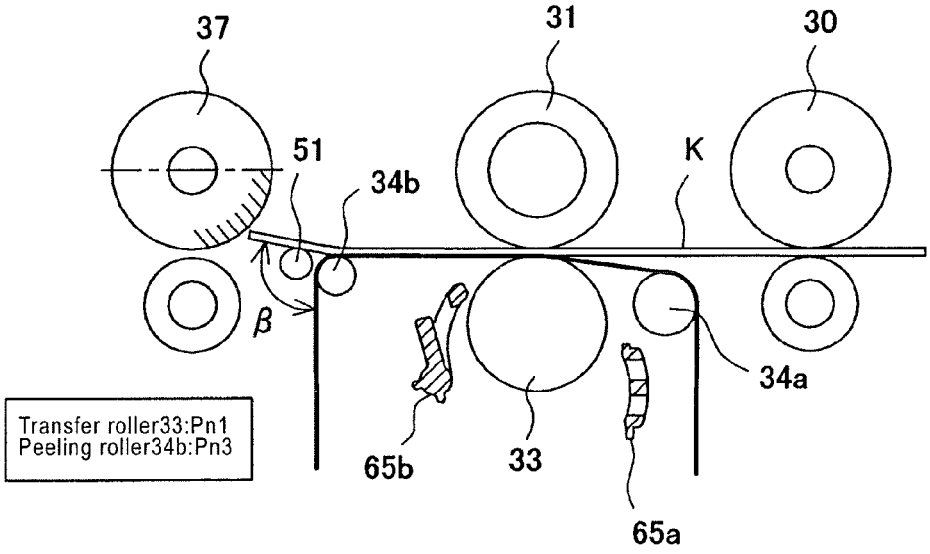
FIGS. 4A and 4B are principle explanatory views of image transfer, where

In addition, the support pin 51 needs to maintain the certain position relationship with the peeling roller 34*b* in a state of the set position. As shown in FIG. 4A, in a state in which the card front end is supported by the support pin 51 after the transfer film 46 is peeled off from the card K, a force is applied to the support pin 51 in the travel direction (downward in the figure) of the peeled transfer film 46. The bearing concave portion of the bracket 69 that supports the support pin 51 is provided in the direction along the travel direction of the transfer film 46, the support pin 51 is supported on the bottom of the bearing concave portion in the set position, and therefore, also when the force in the travel direction of the transfer film 46 is applied from the card K, the bracket 69 is able to securely support the support pin 51. As a matter of course, the support pin 51 may rotate and shift in the direction crossing the transfer film travel direction, and it is necessary to maintain the set position so that the position relationship with the peeling roller 34*b* is not changed when the support pin 51 supports the card K.

In thus laid transfer film 46 are engaged a carry roller 49 and pinch rollers 32*a*, 32*b* disposed on the apparatus side. Then, drive rotating shafts (not shown) coupled to the supply spool 47 and wind spool 48, and the carry roller 49 are driven and rotated to cause the film to travel at the same velocity.

A detailed configuration of the second transfer section will be described herein according to FIGS. 4A and 4B. In the second transfer section are disposed the transfer roller (heat roller) 33, the transfer platen 31, the guide roller 34*a* that guides the transfer film 46, the peeling roller 34*b* which similarly guides the transfer film 46 and peels off the transfer film 46 from the card K, and the support pin 51 that supports the transfer surface side of the card K downstream of the peeling roller 34*b*. Further, provided are the transport rollers 30 that transport the card K to between the transfer roller 33 and the transfer platen 31, and the transport rollers 37 that nip the card passing through the support pin 51 to transport to the downstream side. In addition, the distance between the transport roller 30 and the transport roller 37 is set at a distance shorter than the length Lc in the transport direction of the card K so as to transport the card at the time of normal transport other than the transfer processing.

Figure 4B:
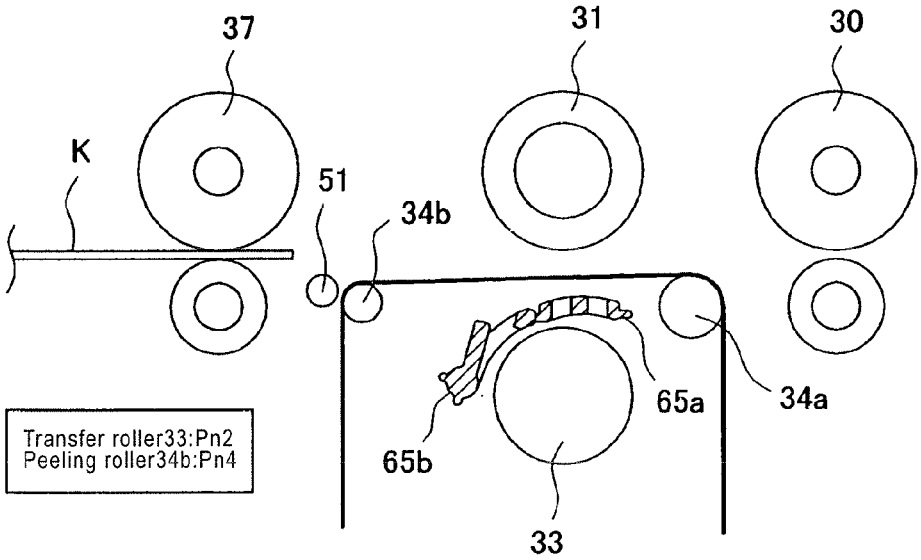
Figure 5:
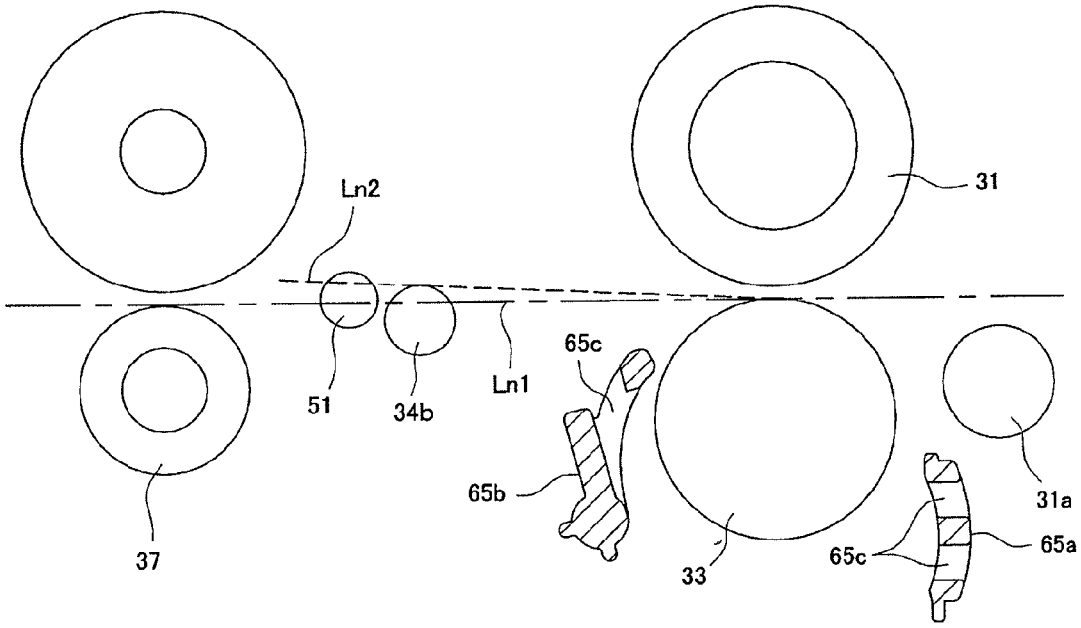
FIG. 5 is an enlarged view illustrating an arrangement relationship of the peeling member and support member in actuation positions.

The transfer roller 33, peeling roller 34*b* and support pin 51 are respectively configured to be able to shift to actuation positions as shown in FIG. 4A and retracted positions as shown in FIG. 4B. The peeling roller 34*b* is set to come into contact with the surface of the card K transported along the transport path P1 via the transfer film 46 in the actuation position. Accordingly, as shown in FIG. 5, the card contact point of the peeling roller 34*b* is offset at least to the transfer platen 31 side (card side) from a straight line Ln1 (first tangent passing through the card contact point of the transfer roller 33 and the card contact point of the transport rollers 37) joining the card contact point of the transfer roller 33 in the actuation position and the card contact point in which the transport rollers 37 contact the card transfer surface, and is not disposed on the transfer roller 33 side relative to the straight line Ln1. In addition, in this Embodiment, the card contact point of the peeling roller 34*b* is offset to the transfer platen side by 1.52 mm from the straight line Ln1. In addition, the card contact point of the peeling roller 34*b* is essentially required not to be on the transfer roller 33 side relative to the straight line Ln1, and may be set on the line of the straight line Ln1.

Accordingly, the transfer film 46 transferred to the card adheres to the card from the heat roller 33 to the peeling roller 34*b*, and is peeled off from the card surface when the card reaches the peeling roller 34*b*. In addition, the peeled transfer film 46 is wound in the direction (downward direction as viewed in the figure) orthogonal to the card, and therefore, the relationship of approximately 90 degrees is kept between the card and the peeled transfer film 46 via the peeling roller 34*b* (the peeling angle β is approximately 90 degrees.).

Figure 20:
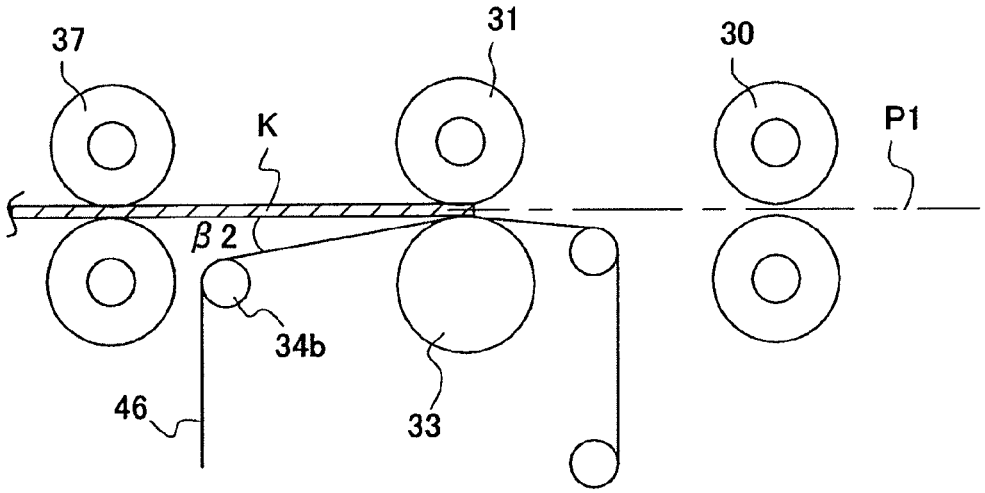
FIG. 20 is a principle explanatory view of conventional image transfer.

For example, as shown in FIG. 20, when the peeling roller 34*b* is provided in the position away from the transport path P1 (while being offset to the transfer roller 33 side), the transferred film 46 peels off from the card before reaching the peeling roller 34*b*. In such a configuration, the position in which the transfer film 46 peels off from the card and the peeling angle (β2) are uncertain, and there is the risk of occurrence of a transfer failure. Further, since the time between transfer and peeling is changed, there is the case that good peeling is not performed. Accordingly, by setting the peeling roller 34*b* in the actuation position of this Embodiment, the peeling angle and the time elapsed before peeling (distance from the transfer roller 33 to the peeling position) is certain, and it is thereby possible to suppress the occurrence of a transfer failure.

As shown in FIG. 4A, the card passing through the peeling roller 34*b* is supported by the support pin 51 without the card front end being pulled in the travel direction of the transfer film 46 to change the posture downward. The card contact point of the support pin 51 is offset to the transfer platen 31 side (card side) from a straight line Ln2 (second tangent passing through the card contact point of the transfer roller 33 and the card contact point of the peeling roller 34*b*) joining the card contact point of the transfer roller 33 in the actuation position and the card contact point of the peeling roller 34*b* in the actuation position, and is not disposed on the transfer roller 33 side relative to the straight line Ln2. In addition, in this Embodiment, the card contact point of the support pin 51 is offset to the transfer platen side by 0.35 mm from the straight line Ln2. In addition, the card contact point of the support pin 51 is essentially required not to be on the transfer roller 33 side relative to the straight line Ln2, and may be set on the line of the straight line Ln2.

When the card contact point of the support pin 51 is disposed below the straight line Ln2, since the card front end is pulled in the travel direction of the transfer film 46 as in the conventional case, the card contact point of the support pin 51 needs to be disposed at least on the straight line Ln2 or on the transfer platen 31 side relative to the straight line Ln2. However, when the contact point is offset to the transfer platen 31 side too much, the level difference between the support pin 51 and the peeling roller 34*b* is large to separate the peeling roller 34*b* from the card K, there is the risk of occurrence of a problem that the peeling position of the transfer film 46 becomes unstable, and therefore, it is desirable to set as appropriate from the type of recording medium to handle and the like.

Further, when the distance from the peeling roller 34*b* to the support pin 51 is large, since the state in which the card front end is not supported is long, it is desirable to place the support pin 51 just behind the peeling roller 34*b*. Accordingly, in this Embodiment, the diameter of the peeling roller 34*b* is 5 mm, the diameter of the support pin 51 is 3 mm, the distance between the center of the peeling roller 34*b* and the center of the support pin 51 is 5 mm, and therefore, the clearance between the peeling roller 34*b* and the support pin 51 is 1 mm. By this means, by making the support pin 51 thinner than the peeling roller 34*b*, it is possible to bring the support pin 51 close to the peeling roller 34*b*. However, when the support pin is made too thin, since the strength to hold the card K is not kept, it is desirable to thin the support pin 51 with the strength left to some extent.

Furthermore, as described previously, the peeling roller 34*b* and support pin 51 are supported by the same bracket 69, and therefore, it is ease positioning the height relationship between the peeling roller 34*b* and support pin 51. For example, the support pin 51 may be provided on the apparatus body side. In this case, it is necessary to shift the support pin 51 on the apparatus body side and the peeling roller 34*b* on the film cassette 50 side to respective actuation positions and retracted positions, it is further necessary to maintain the above-mentioned arrangement relationship when both the pin and the roller are in the actuation positions, and therefore, required is high part processing accuracy.

In addition, the card front end is slightly raised by the support pin 51, and therefore, when the transport rollers 37 downstream from the support pin 51 are disposed in a far position, the card front end is not nipped by the transport rollers 37. Accordingly, the transport rollers 37 are disposed in a position in which the card front end enters the lower-half region (oblique-line portion of the transport roller 37 of FIG. 4A) of the upper transport roller 37.

Further, the transfer roller 33 is configured to come into press-contact and separate with/from the platen 31. Control means 70, described later, shifts the transfer roller 33 to the actuation position (Pn1) to bring into press-contact in transferring the image onto the card, and after image formation (after the card rear end passes through the transfer roller 33), shifts the roller 33 to the retracted position (Pn2) to separate. By this means, the transfer film 46 is prevented from contacting the transfer roller (heat roller) 33 after the card rear end passes through the transfer roller 33, and from becoming deformed due to heat of the transfer roller 33.

Furthermore, the control means 70 shifts the peeling roller 34*b* and support pin 51 from the actuation position (Pn3) to the retracted position (Pn4) at timing at which the card rear end passes through the support pin 51. Herein, since the peeling roller 34*b* and support pin 51 are shifted to the retracted position, the card is prevented from colliding with the support pin 51 and peeling roller 34*b* in switchback-transporting the card toward the reverse unit F on the upstream side in the transport path in performing two-side printing. Such control eliminates the risk that the transfer film is acted upon by excessive heat and becomes deformed, and also the occurrence of a transfer failure in peeling off the transfer film 46.

Therefore, in order to move the transfer roller 33, peeling roller 34 and support pin 51 up and down, the control means controls the transfer member up-and-down means 61 and peeling member up-and-down means 62 (shift means) described later. This control is to shift the position of the transfer roller 33 from the retracted position (Pn2) to the actuation position (Pn1) at predicted time the card front end arrives at the transfer platen 31. Further, in tandem therewith (for example, print command signal, job end signal on the upstream side or the like), the control means shifts the peeling roller 34*b* and support pin 51 from the retracted position (Pn4) to the actuation position (Pn3).

In this state, the image is transferred to the card shifting to the platen position at a predetermined velocity beginning with the front end to the rear end. At predicted time the card rear end passes through the transfer roller 33, the transfer roller 33 is shifted to the retracted position (Pn2). Then, the transfer film 46 is supported by the guide roller 34*a* and peeling roller 34*b* with a part thereof beaten onto the card surface. Subsequently, with the shift of the card in the discharge direction, the transfer film 46 is peeled off gradually from the card surface. At this point, the card front end is supported by the support pin 51.

In this process of image transfer, the transfer film 46 is peeled off in the same angle direction from the card front end to the rear end at a certain peeling angle β with respect to the card surface. Accordingly, unevenness does not occur in the image transferred to the card.

Figure 6:
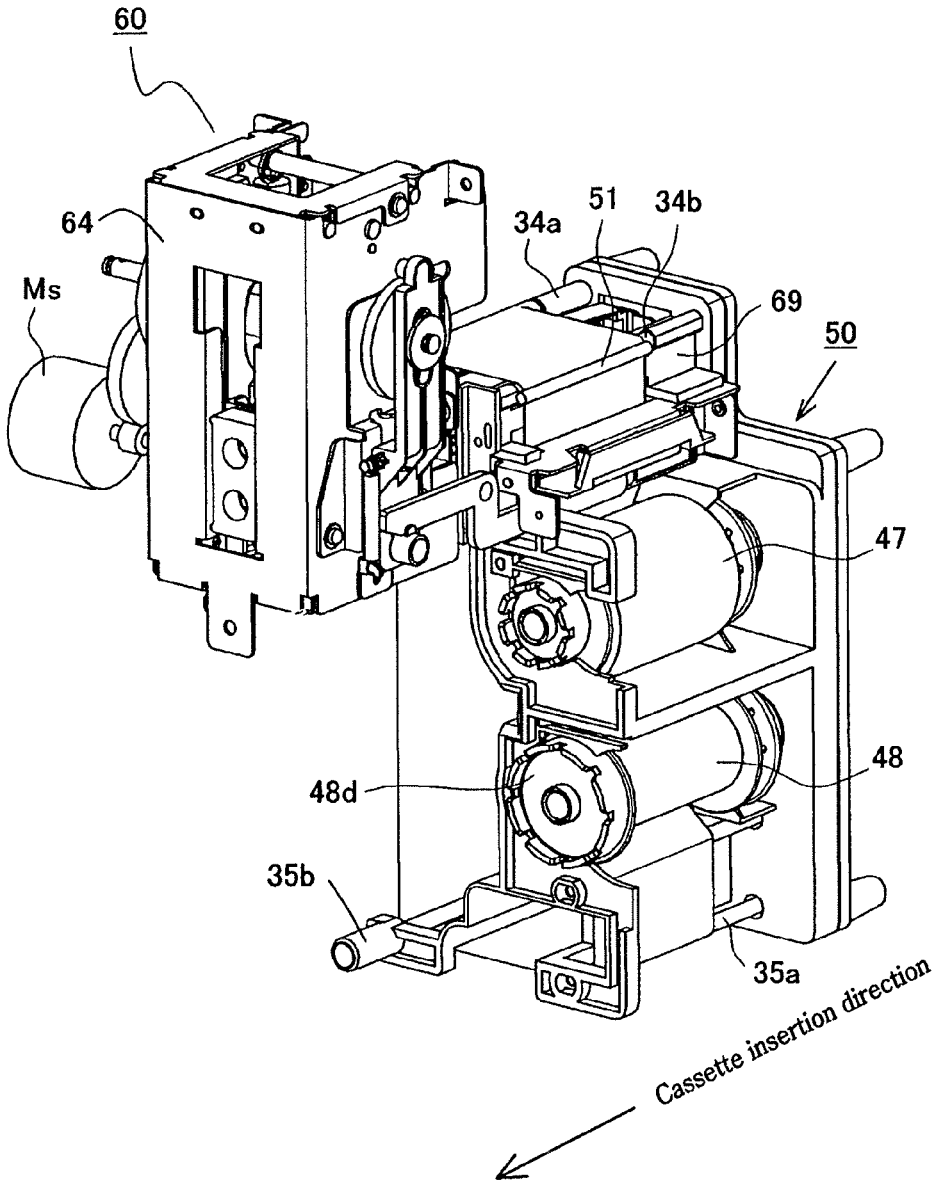
FIG. 6 is a perspective configuration view of a transfer unit and film cassette in the apparatus of FIG. 1.

Configurations of the above-mentioned transfer member up-and-down means 61 and peeling member up-and-down means 62 will be described next. FIG. 6 is an explanatory view showing the entire configuration of the film cassette 50 as described previously, transfer member up-and-down means 61 and peeling member up-and-down means 62. The up-and-down means 61, 62 and transfer roller 33 are attached to the apparatus frame. Meanwhile, the peeling roller 34*b* and support pin 51 are attached to the film cassette 50 side.

Figure 7:
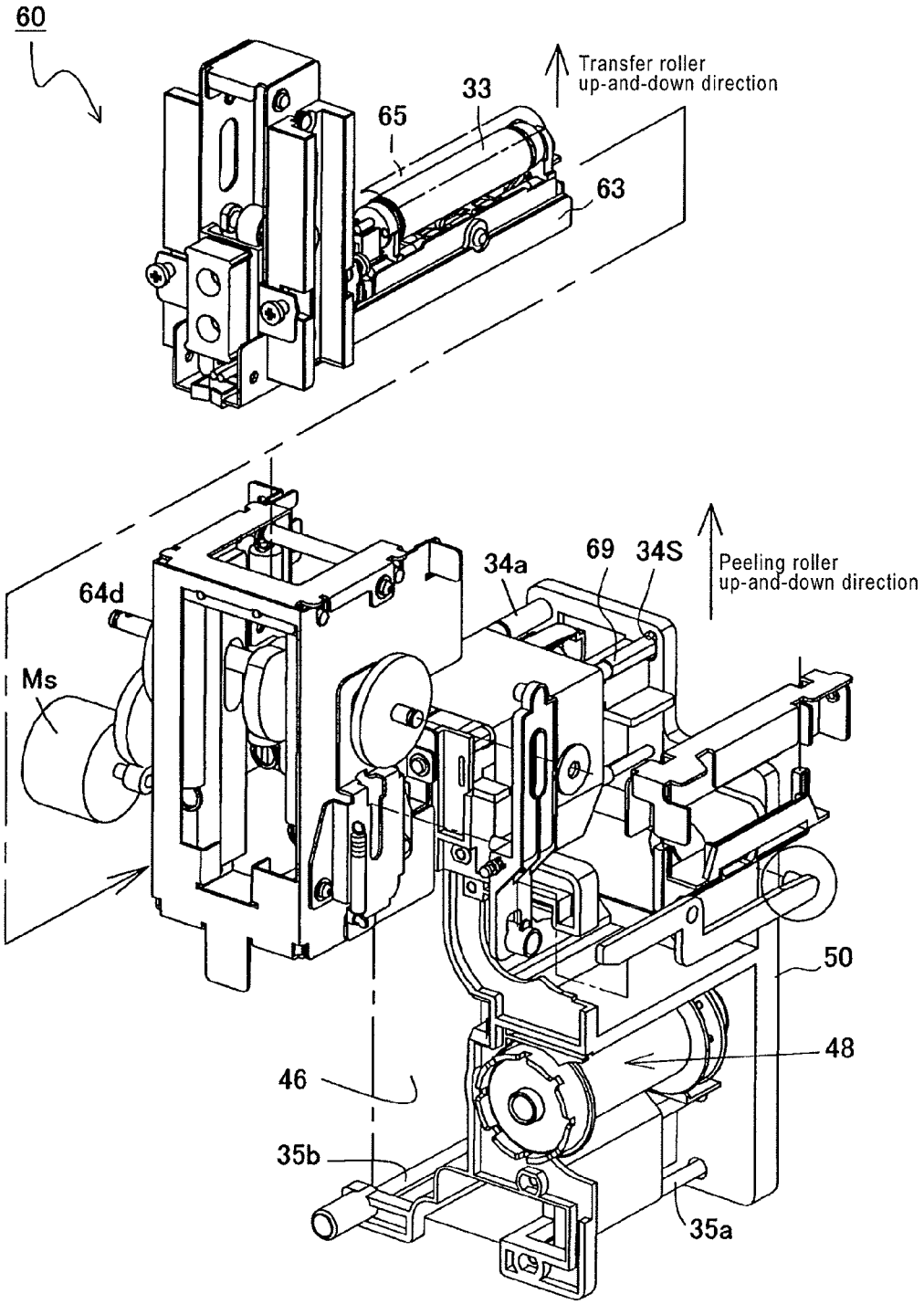
FIG. 7 is an assembly exploded view of the transfer unit in the apparatus of FIG. 6.

In FIG. 6, the film cassette 50 is inserted in the apparatus frame to be attachable and detachable in the arrow direction shown in the figure. Then, the transfer member up-and-down means 61, peeling member up-and-down means 62 and transfer roller 33 provided in the apparatus frame and the transfer film 46 of the film cassette 50 are combined. FIG. 7 is an assembly exploded view of the transfer member up-and-down means 61, peeling member up-and-down means 62 and transfer roller 33, and an up-and-down frame 63 provided with the transfer roller 33 is supported by the transfer member up-and-down means 61 to be able to move up and down in the arrow direction shown in the figure. Further, a fit portion 69S of the bracket 69 that supports the peeling roller 34*b* and support pin 51 is supported by a fit groove 50S on the film cassette 50 side to be able to move up and down (see FIG. 2) and attached.

Figure 8A:
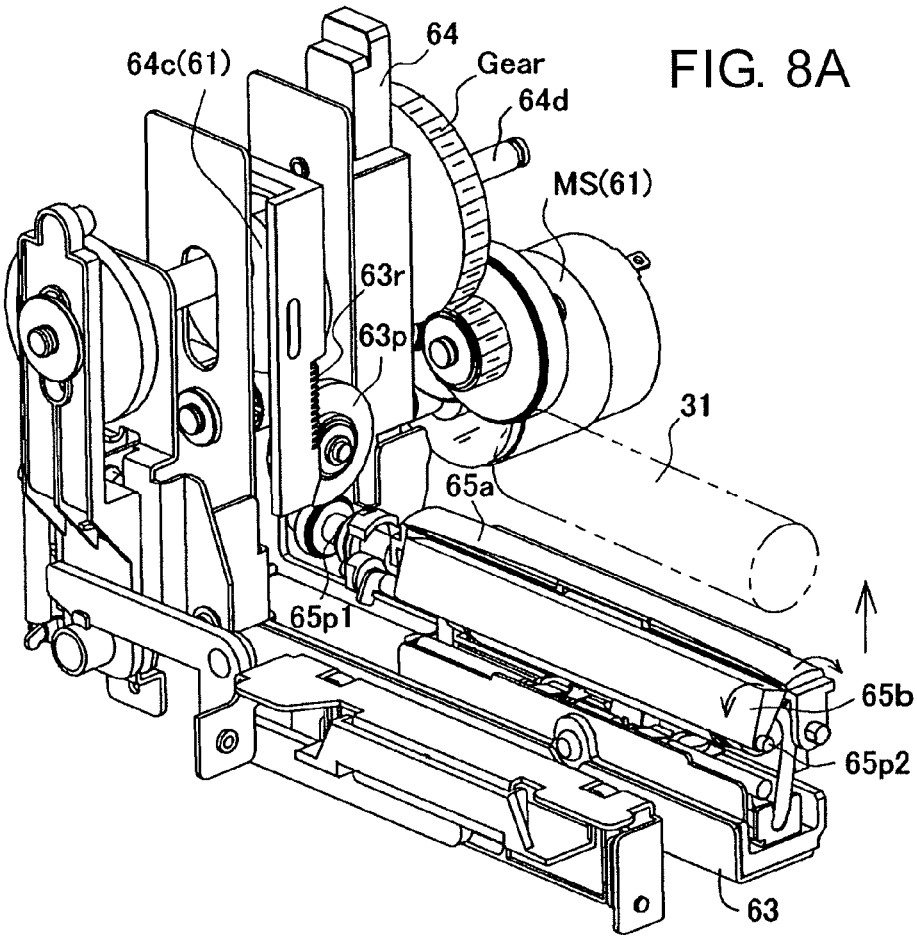
FIGS. 8A and 8B illustrate an up-and-down mechanism of a transfer roller, where

FIG. 8A shows a configuration of the up-and-down frame 63 provided with the transfer roller 33. The transfer roller 33 is attached, in the position opposed to the transfer platen (roller, in the FIG. 31, to a unit frame 64 to move up and down in the arrow direction shown in FIG. 8A together with the up-and-down frame 63. Then, a shift motor MS is attached to the unit frame 64, and the rotating shaft of the motor is provided with a shift cam 64*c* (for example, eccentric cam). By rotation of the shift cam 64*c*, the up-and-down frame 63 fitted with the cam in a long groove (cam follower; not shown) moves up and down in the vertical direction in FIG. 8A.

Further, the transfer roller 33 is provided with open/close covers 65*a*, 65*b* (which are an open/close cover 65 in combination) in the position opposed to the transfer platen 31 to rotate (open and close) on the spindles 65*p*1, 65*p*2 in the arrow direction shown in the figure. The open/close cover 65 prevents a user from touching the transfer roller 33 of high heat by the finger. Therefore, when the transfer roller 33 is in the retracted position (Pn2), the open/close cover 65 covers the roller surface, and when the card causes a jam and the user performs jam clearing operation, guards against touching the roller surface. When the transfer roller 33 is in the actuation position (Pn1), the cover 65 retracts from the roller surface, and the transfer film 46 comes into press-contact with the platen 31.

For the open/close mechanism, the unit frame 64 is integrally provided with a rack 63*r*, and the up-and-down frame 63 is provided with a pinion 63*p* meshing with the rack. The pinion 63*p* is gear-coupled to the spindles 65*p*1, 65*p*2 of the open/close cover 65. Accordingly, when the shift cam 64*c* is rotated by the shift motor MS to move the up-and-down frame 63 up in the arrow direction in FIG. 8A, the open/close covers 65*a*, 65*b* respectively rotate in the arrow directions shown in the figure.

As is clarified from the above-mentioned description, the transfer member up-and-down means 61, which moves the transfer roller 33 up and down between the actuation position (Pn1) in press-contact with the card and the separated retracted position (Pn2), is comprised of the shift motor MS and the shift cam 64*c*. Further, the transfer member up-and-down means 61 opens and closes the open/close cover 65 of the transfer roller 33 between an open position (FIG. 4A) and a close position (FIG. 4B).

Figure 8B:
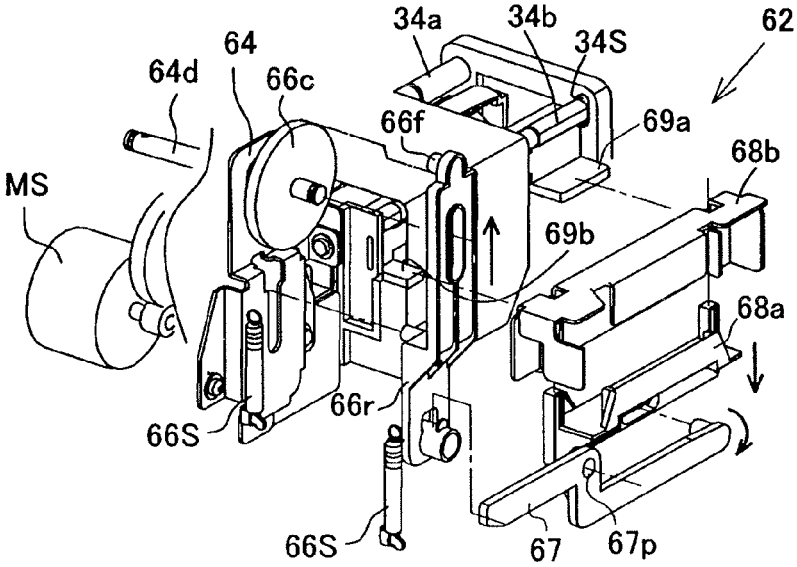

Further, described is the peeling member up-and-down means 62 for moving the peeling member 34*b* up and down between the actuation position (Pn3) for peeling off the transfer film 46 of which the image is transferred to the recording medium K and the retracted position (Pn4) separated from the recording medium K. FIG. 85 is an explanatory view of only a configuration of the peeling member up-and-down means 62 extracted from the mechanism of FIG. 7. As shown in FIG. 8B, a drive cam 66*c* is coupled to a drive rotating shaft 64*d* gear-coupled to the shift motor MS. A lever 66*r* provided with a cam follower 66*f* engaging in the drive cam 66*c* is supported movably up and down by the unit frame 64 with a slit and a pin to move up and down in the vertical direction in FIG. 8B. A return spring 66S is laid between the lever 66*r* and the unit frame 64.

Accordingly, when the drive cam 66*c* rotates by rotation of the shift motor MS, the lever 66*r* having the cam follower 66*f* moves up and down. In addition, as described later, the drive cam 66*c* causes the peeling member 34*b* to wait in the retracted position (Pn4), and shifts the roller 34*b* from this state to the actuation position (Pn3) by angle control of the shift motor MS.

Then, the lever 66*r* is raised in the arrow direction by rotating the drive cam 66*c*. The lever 66*r* is coupled to a swing lever 67, and the swing lever 67 rotates (swings) on the spindle 67*p* in the arrow direction in FIG. 8B. Then, an up-and-down lever 68*a* pin-slit-coupled to the swing lever 67 moves downward in the arrow direction. An actuation lever 68*b* integral with the up-and-down lever 68*a* engages in peeling pin brackets 69*a*, 69*b*. In addition, the up-and-down lever 68*a* is restricted in motion in the vertical-motion direction in the unit frame 64 by pin-slit coupling.

Accordingly, the swing lever 67 swings by up-and-down motion of the lever 66*r* which moves upward by the drive cam 66*c* and moves downward by the return spring 66S, the up-and-down lever 68*a* and the actuation lever 68*b* move up and down, and the peeling pin brackets 69*a*, 69*b* engaging in the actuation lever 68*b* move up and down. The peeling pin brackets 69*a*, 69*b* are integrally attached to opposite end portions of the peeling roller (peeling member) 34*b*.

As is clarified from the above-mentioned description, the peeling member up-and-down means 62 is comprised of the shift motor MS, drive cam 66*c*, lever 66*r*, swing lever 67, up-and-down lever 68*a*, and actuation lever 68*b*. The apparatus shown in the figure is characterized by moving the opposite end portions of the peeling roller (peeling member) 34*b* up and down equally by the same amount without leaning by the actuation lever 68*b*.

Figure 10:
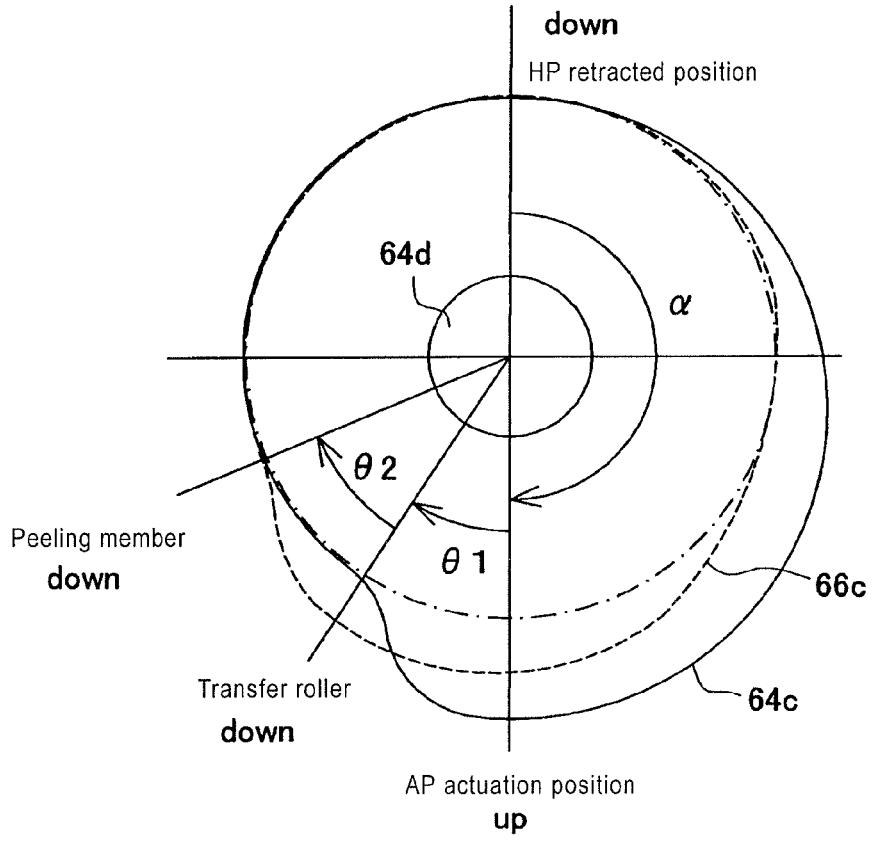
FIG. 10 is a relationship view of a drive cam and a drive rotating shaft in the apparatus shown in FIGS. 8A and 8B.

The relationship among the shift cam 64*c*, drive cam 66C and drive rotating shaft 64*d* as, described above will be described next with reference to a cam diagram in FIG. 10. The shift cam 64*c* and drive cam 66*c* are coupled to the drive rotating shaft 64*d* gear-coupled to the shift motor MS. For example, both of these cams form cam surfaces as described below. Both cams shift the transfer roller 33 to the "down" position and the peeling roller 34*b* to the "down" position when being in home positions HP, where the "down" position is the retracted position. From this state, for example, the drive rotating shaft 64 is rotated 180 degrees. At this point, the shift cam 64*c* and drive cam 66*c* shift the transfer roller 33 to the "up" position, and the peeling roller 34 to the "up" position, where the "up" position is the actuation position.

When the drive rotating shaft 64*d* is further rotated an angle θ1 from the 180-degree position, the shift cam 64*c* shifts the transfer roller 33 to the "down" position, and the drive cam 66*c* maintains the peeling roller 34 in the "up" position. Then, when the drive rotating shaft 64*d* is rotated an angle θ2, the shift cam 64*c* holds the transfer roller 33 in the "down" position, and maintains the peeling roller 34 in the "down" position. In addition, such a cam configuration is not limited to cam shapes as shown in the figure, and is capable of adopting various cam shapes such as an eccentric cam and others.

In addition, in this Embodiment, the hot peeling type film is used for the transfer film 46. As characteristics of the hot peeling type film, it is possible to peel off the transfer film neatly from the card in peeling off the film when the film is still warm after transferring the transfer film to the card. At this point, when the temperature of the transfer film is lowered, the peeling layer of the transfer film is not peeled off neatly, and the whitening phenomenon occurs such that the transfer surface blurs whitely, resulting in a transfer failure. Further, although the film is warm to some extent, unless the behavior (posture) of the card after peeling is stable, the peeling position of the transfer film is not stabilized, the whitening phenomenon occurs, and similarly a transfer failure arises. However, in peeling when the transfer film is excessively warm, although the whitening phenomenon does not occur irrespective of the behavior of the card, the peeling layer is made easier to peel than usual, peeling residues occur by the fact that the transfer film peels off on the outer side than the card end edge, and the card end edge portion is defiled.

Accordingly, since the posture of the card K after peeling is stabilized by the support pin 51 as described above, it is possible to suppress the transfer failure due to whitening. However, the posture of the card front end is unstable for a period during which the card front end reaches the transport rollers 37 from the support pin 51, and therefore, there is the case where only the card front end develops the transfer failure due to whitening. After the card front portion is nipped by the transport rollers 37, since the posture of the entire card is stabilized, the transfer failure is hard to occur behind the card front end portion.

Figure 9:
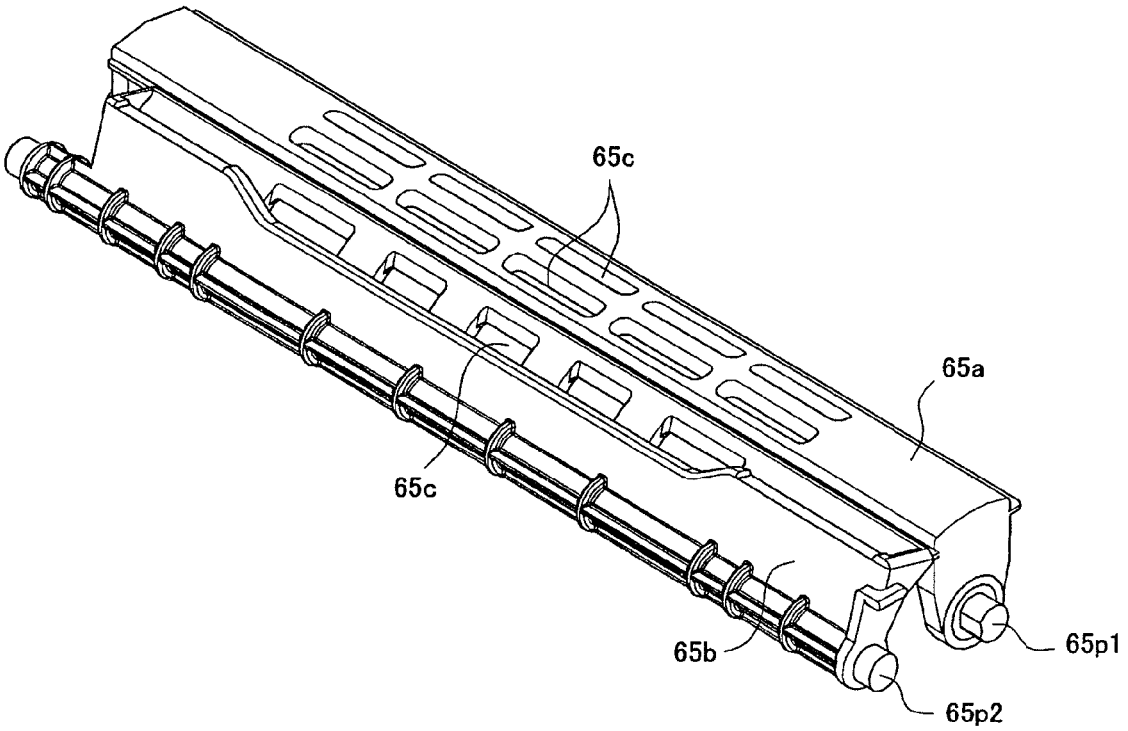
FIG. 9 is an enlarged perspective view of an open/close cover.

Then, in this Embodiment, whitening of the card front end portion is suppressed by preheating the card front end portion (portion corresponding to the distance between the support pin 51 and the transport roller 37) before transfer. Therefore, the open/close cover 65 that covers the transfer roller 33 in the retracted position is provided with openings 65*c* as shown in FIG. 9, and by positioning the card front end in a position (preheating position) between the transfer roller 33 and the transfer platen 31, it is possible to convey heat of the transfer roller 33 to the card front end.

In preheating the card front end by heat of the transfer roller 33, since preheating is performed through the transfer film 46, when a part of the transfer film 46 is excessively warmed, only the warmed portion becomes easy to peel, and there is the risk that peeling residues occur. Further, when preheating of the card front end is performed in an independent process, the entire processing time is long, and productivity degrades. Accordingly, in this Embodiment, preheating of the card front end is performed during the time the first transfer section forms an image on the transfer film 46.

When the first transfer section performs image formation processing, each color of ink ribbons of a plurality of colors (for example, four colors of cyan, magenta, yellow and black) is overlaid and printed in an image formation region of the transfer film 46 by the thermal head 40. Therefore, at the time of image formation in the first transfer section, since the transfer film 46 always performs reciprocating transport operation, only a part of the transfer film 46 is not excessively warmed in card preheating, it is thereby possible to preheat the card front end during the operation, and preheating does not affect the entire processing time.

Figure 17:
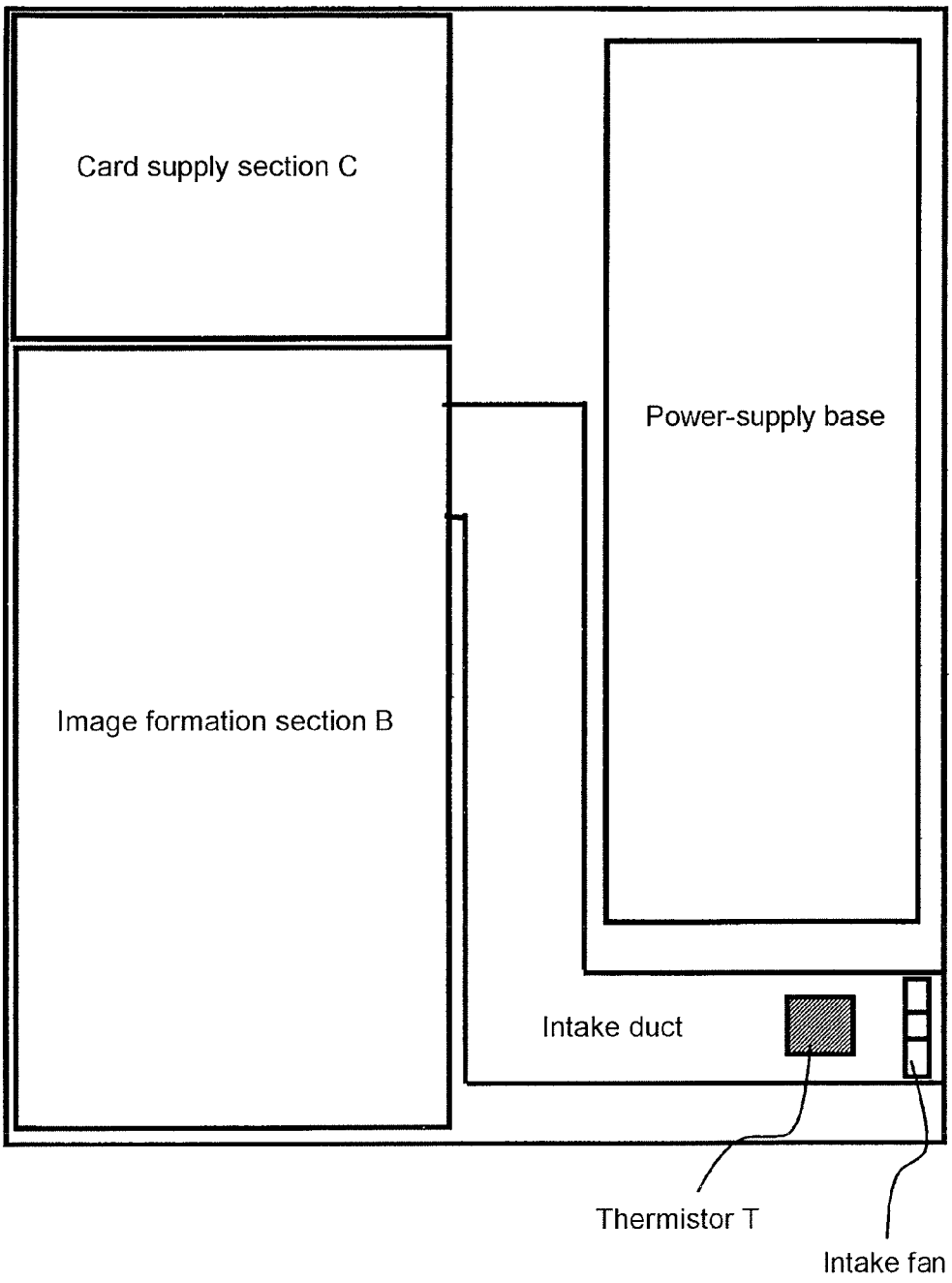
FIG. 17 is a cross-sectional view of the apparatus viewed from the side direction and is a view showing a position of a thermistor.

Further, it is determined whether or not to execute preheating of the card front end depending on an environmental temperature of the apparatus. The extent to which the card K is cold is judged by detecting the environmental temperature with a thermistor T. Accordingly, it is preferable that the thermistor T is provided in the card supply section C (see FIG. 1) or near an intake duct inside the apparatus (see FIG. 17). When the environmental temperature is low and the card K is cold, since whitening tends to occur in the card front end portion as described above, it is necessary to perform preheating of the card front end. Conversely, when preheating of the card front end is performed in a state in which the environmental temperature is high and the card K is warm, temperatures of the card front end portion and transfer film 46 excessively rise, and there is the risk that peeling residues occur.

However, when the environmental temperature is extremely low and the card is extremely cold, by preheating only the card front end, only the card front end portion allows good peeling, and there is the risk that whitening occurs on the rear end side behind the front end. Accordingly, in such a case, it is necessary to widen the preheating region and/or extend the preheating time.

In this Embodiment, as shown in FIG. 15, the preheating region and preheating time is controlled corresponding to three environmental temperatures. First, in the case of extremely low temperature such that the environmental temperature is extremely low, the preheating region is not only the card front end portion, and preheating is also performed in the card center portion and up to near the rear end portion. In this case, the portion to warm by preheating is positioned in the preheating position while shifting the card K gradually. Further, in the case of extremely low temperature, the time to preheat is also increased to warm the card K (for example, the preheating time is 20 seconds.).

In the case where the environmental temperature is low temperature, the preheating region on the card K is only the card front end portion. In this case, as described above, the card front end region (for example, the preheating region is about 10 mm) corresponding to the distance from the support pin 51 to the transport roller 37 is positioned in the preheating position. Further, the preheating time is also set to be shorter than that in the case of extremely low temperature (for example, the preheating time is 10 seconds.).

When the environmental temperature is room temperature (for example, 25°) or more, preheating on the card K is not performed (the preheating region is 0 mm and the preheating time is 0 second.). This is because peeling residues occur when preheating is performed in this state. Further, in reversing the side of the card K in the reverse unit F after frontside transfer and performing backside transfer, since the card K is warmed in frontside transfer, the card temperature is high, and when preheating is performed in this state, peeling residues occur. Accordingly, the preheating treatment is performed corresponding to the environmental temperature in frontside transfer, and is not performed in backside transfer. In addition, in the case where an interval of predetermined time or more has elapsed before backside transfer after frontside transfer, the preheating treatment may be performed with a smaller preheating amount than in frontside transfer.

In addition, in this Embodiment, the wind tension (hereinafter, peeling tension) in peeling off the transfer film is changed between frontside transfer and backside transfer. The peeling tension is changed by transfer film wind torque of the supply spool 47 of the transfer film 46. The transfer film 46 used in this Embodiment has characteristics of being easy to peel when the temperature of the film is high, while being hard to peel when the temperature is low.

The peeling tension (wind torque by the supply spool 47) required for the transfer film 46 to be peeled off from the card K varies with the adhesion force between the card K and transfer film 46. This adhesion force is acted upon by a temperature of an adhesion surface between the card K and the transfer film 46, and the temperature of the adhesion surface varies with the temperature of the card K. In a state in which the card temperature is low and as a result, the temperature of the adhesion surface between the card K and the transfer film 46 is low, when the peeling tension is low, the transfer film 46 is not peeled off in the position of the peeling roller 34*b* and is peeled off on the downstream side from the peeling roller 34*b*, and therefore, the peeling angle differs. Further, in this Embodiment, since the support pin 51 is disposed on the downstream side of the peeling roller, 34*b*, there is a possibility that the transfer films 46 enters into between the support pin 51 and the card K, and there is the risk that a transfer failure and/or jam occurs.

Figure 21:
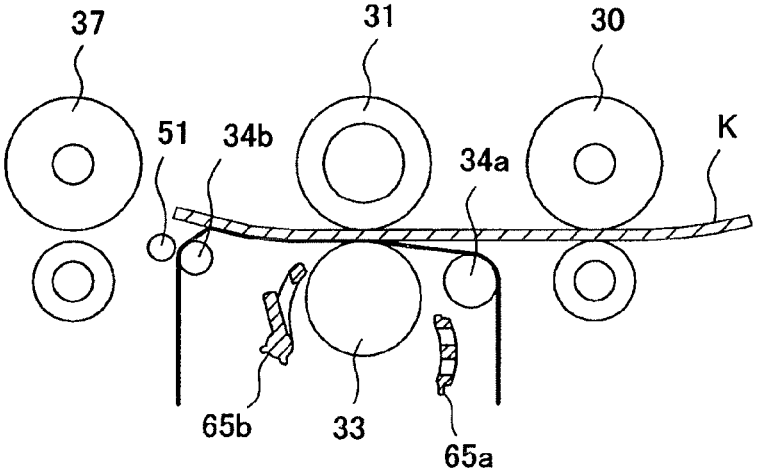
FIG. 21 is a view illustrating a problem at the time of backside transfer.

Conversely, in a state in which the card temperature is high and as a result, the temperature of the adhesion surface between the card K and the transfer film 46 is high, when the peeling tension is high, the transfer film 46 is easy to peel off and is peeled off on the upstream side from the peeling roller 34*b*, and there is the risk that the above-mentioned peeling residues occur. Particularly, in the case of performing backside transfer after frontside transfer, since the temperature of the card K is high, the transfer film 46 tends to peel off. Further, when the transfer processing is performed on the card K, since the card K is curved in the direction in which the transfer surface contracts, the card K is curved in the direction in which the front end of the card K separates from the peeling roller 34*b* in backside transfer as shown in FIG. 21. When the peeling tension is increased in the state in which the card K is curved, a gap is created between the front end of the card K and the peeling roller 34*b*, and the peeling angle differs, resulting in early peeling. Further, at the time of backside transfer, since the temperature of the adhesion surface is high, the possibility that peeling residues occur by early peeling is high.

Accordingly, in this Embodiment, at the time of frontside transfer, since the temperature of the card K varies with the environmental temperature outside the apparatus, a preheating amount in the preheating treatment on the card K and the peeling tension are determined corresponding to the environmental temperature (temperature of the card K). In the case where the environmental temperature is an extremely low temperature, since the card K is cold, as described above, the preheating amount is set to be large, and the peeling tension is also set to be high. In the case where the environmental temperature is a low temperature, as described above, the preheating treatment is performed on only the card front end portion, and the peeling tension is set to be lower than that at the time of extremely low temperature. When the environmental temperature is room temperature or more, the preheating treatment is not performed, and the peeling tension is set to be lower than that in low temperature.

Subsequently, when backside transfer is performed, since the temperature of the card K is high, the above-mentioned setting (no preheating treatment, low peeling tension) of room temperature or more is made irrespective of the environmental temperature. By this means, it is possible to suppress both the occurrence of whitening that tends to occur when the adhesion surface temperature is low, and the occurrence of peeling residues that tend to occur when the adhesion surface temperature is high.

In addition, the peeling tension is set at weaker torque than nip force MN by the nip pressure and friction force of the card K due to the transport roller pairs 30, 37, transfer roller 33 and transfer platen 31. When the peeling tension is set at stronger torque than the nip force MN, the transfer film 46 pulls the card K, and there is the risk that the nipped card K slides between rollers to displace the image under transfer and that peeling residues occur due to early peeling. Accordingly, the peeling tension is set at torque in the range of not affecting card transport.

The above-mentioned setting of the preheating treatment and peeling tension mainly has the effect on suppression of the occurrence of whitening and peeling residues on the card front end side, and depending on the back tension on the card rear end side, there is a possibility that peeling residues occur at the card rear end.

In this Embodiment, a feed amount of the transfer film 46 during the transfer processing by the image transfer section is managed by the carry roller 49. When a transport amount of the transfer film 46 fed by the carry roller 49 is smaller than a transport amount of the card K (and the transfer film 46) under the transfer processing, the back tension of the transfer film 46 is excessively applied to the nip point of the card nipped by the transfer roller 33 and the transfer platen 31, and the image to transfer to the card K is displaced. Therefore, the feed amount of the transfer film 46 is made larger than the transport amount of the card K during the transfer processing to sag the transfer film 46 on the card rear end side. In addition, the transport amount of the card K is controlled by the stepping motor connected to the transport rollers 30, 37 and transfer platen 31, and the feed amount of the transfer film 46 is controlled by the stepping motor connected to the carry roller 49. By this means, the image is not displaced by the back tension of the transfer film 46.

However, in the case that the transfer film 46 on the upstream side from the card rear end sags in performing peeling of the card rear end after finishing the transfer processing, the transfer film 46 is not peeled off when the card rear end passes through the peeling roller 34*b*, the peeling position is displaced to the downstream side from the peeling roller 34*b*, the peeling angle differs, and peeling residues thereby occur on the card rear end side.

Accordingly, in this Embodiment, for a period during which the card rear end passes through the transfer roller 33 and arrives at the peeling roller 34*b*, the transport amount of the transfer film 46 by the carry roller 49 is decreased to cancel the sag of the transfer film 46. In addition, when the back tension of the transfer film 46 is applied immediately after the card rear end passes through the transfer roller 33, since the temperature of the adhesion surface between the card K and the transfer film 46 is high, the transfer film 46 peels off before the card rear end arrives at the peeling roller 34*b*, and peeling residues occur due to early peeling.

Therefore, in this Embodiment, for example, when the transport amount of the card K from transfer start to transfer end is set at "100", the feed amount of the transfer film 46 is set at "103", and subsequently, when the transport amount of the card K of the time the card rear end travels from the transfer roller 33 to the peeling roller 34*b* is set at "20", the transport amount of the transfer film 46 is set at "17". By this means, the sag of the transfer film 46 is eliminated when the card rear end passes through the peeling roller 34*b*, the peeling position of the card rear end portion is thereby not displaced, and it is possible to perform excellent peeling.

In addition, since each of the transport rollers 30, 37, transfer platen 31 and carry roller 49 is connected to the stepping motor, it is possible to control the transport amounts of the card K and transfer film 46 with high accuracy. Further, since the carry roller 49 for feeding the transfer film 46 is not a spool for winding the transfer film 46, it is possible to use the drive amount of the stepping motor as the rotation amount of the carry roller 49 (feed amount of the transfer film 46) without modification. In the case of the spool for winding the transfer film 46, the feed amount of the transfer film 96 differs according to the diameter of the wound transfer film 46 even in the same motor drive amount, and therefore, the carry roller 49 for nipping the transfer film 46 to feed enables the transport amount of the transfer film 46 to be controlled with higher accuracy.

[Control Configuration]

Figure 11:
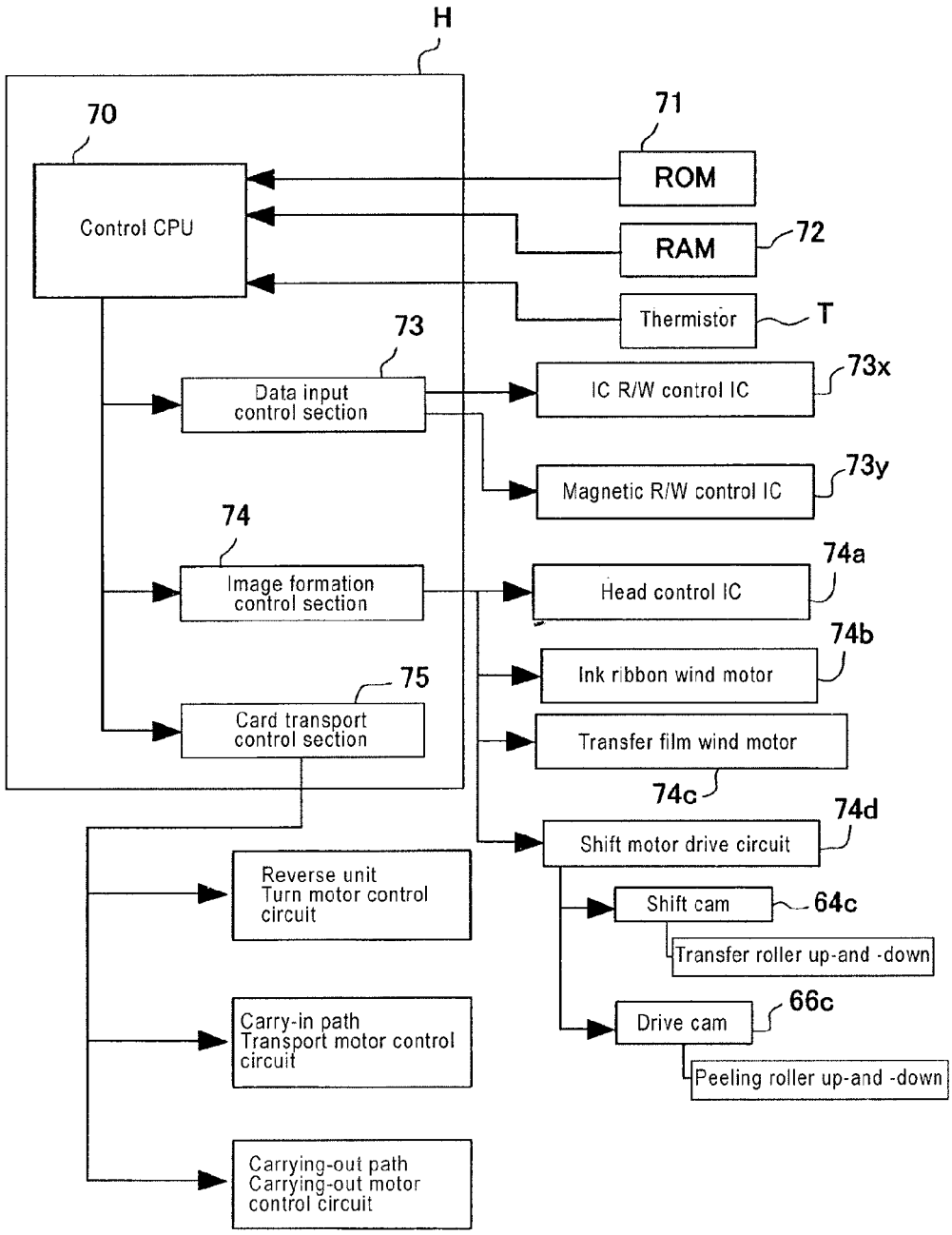
FIG. 11 is a control configuration diagram according to the apparatus of FIG. 1.

A control configuration according to the present invention will be described in FIG. 11. For example, a control section H is comprised of a control CPU 70, and the CPU 70 is provided with ROM 71 and RAM 72. Then, in the control CPU 70 are formed a data input control section 73, image formation control section 74 and card transport control section 75. Then, the card transport control section 75 transmits command signals to a drive circuit of the drive motor, not shown, so as to control card transport means (transport roller pairs shown in FIG. 1) disposed in the carry-in path P1 and the carrying-out path P2. The card transport control section 75 transmits command signals to a drive circuit of the turn motor of the reverse unit F. Further, the environmental temperature is detected with the thermistor T, and the card transport control section 75 performs card transport control to preheat.

The card transport control section 75 is electrically connected to sensors Se1 to Se10 to receive respective state signals of the sensors. Concurrently therewith, the card transport control section 75 is connected to receive job signals from the data input control section 73.

The data input control section 73 is configured to transmit command signals to control transmission and reception of input data to an IC 73*x* for data R/W built in a magnetic recording unit A1, and similarly transmit command signals to an IC 73*y* for data R/W in an IC recording section A2. The image formation control section 74 controls image formation on the frontside and backside of the card in the image formation section B.

In this image formation control, an image is transferred to the card surface with the transfer platen 31 corresponding to transport of the card controlled in the card transport control section 75. Therefore, the image formation control section 74 is provided with an ink ribbon wind motor control section 74*b*, transfer film wind motor control section 74*c*, and shift motor MS control section 74*d* to form the image on the transfer film 46 with the image formation platen 45.

Then, in the RAM 72, processing time to input data on the card in the data input section (magnetic·IC recording section) is stored, for example, in a data table. Further, the card transport control section 71 is provided with monitor means H1, and both are incorporated into control programs of the control CPU 70. The monitor means H1 is configured to receive the state signals of sensor Se1 to Se10, and job signals from the data input control section 73 so as to monitor transport states of cards existing inside the apparatus.

Figure 14:
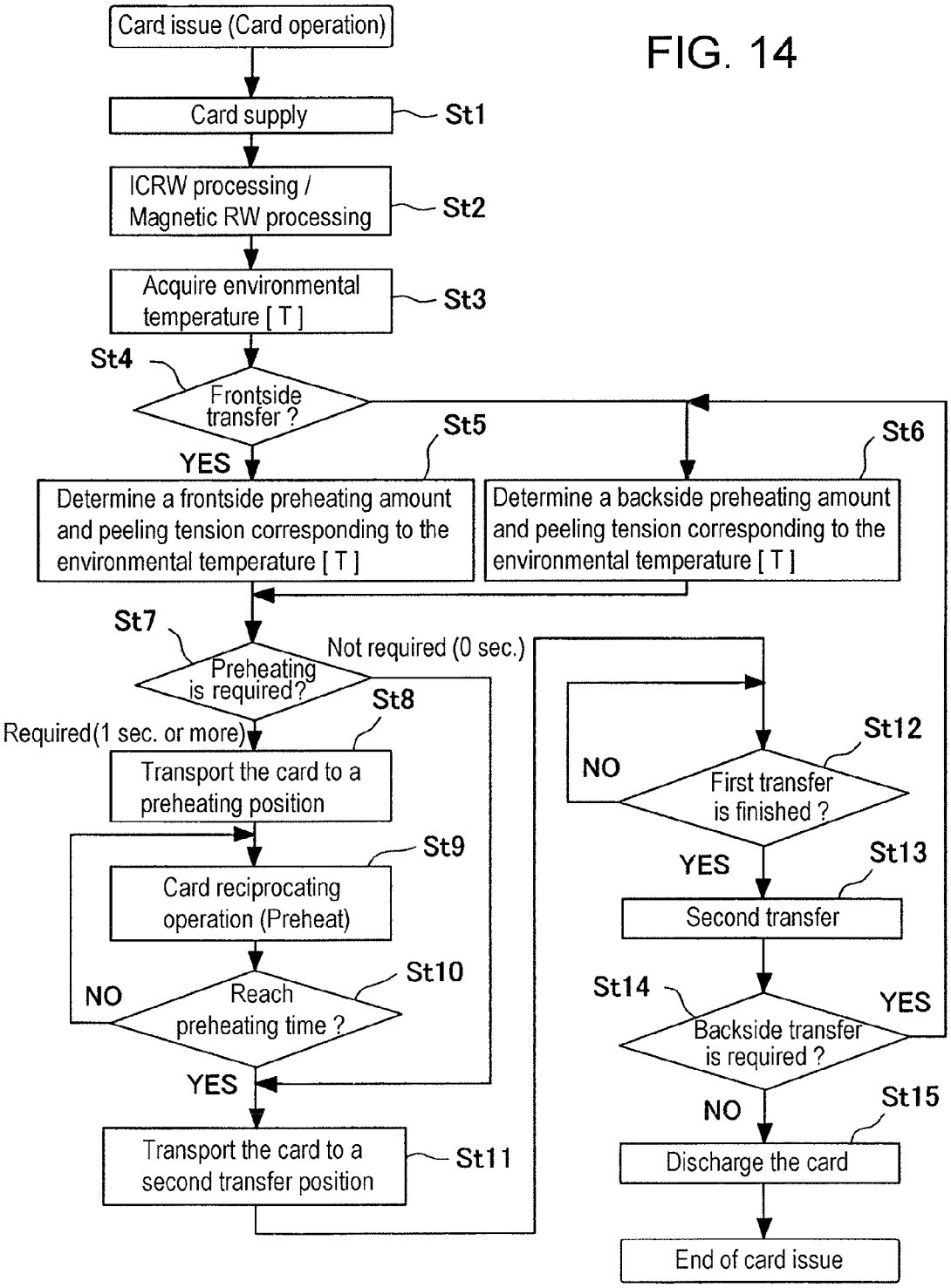
FIG. 14 is a flowchart on card issue processing.

Herein, entire operation of a card printing apparatus of this Embodiment is described according to motion of the card K (FIG. 14). First, upon receiving printing data and information recording data from a higher apparatus such as a personal computer, cards K are supplied to the reverse unit F on a sheet-by-sheet basis from the card supply section C (St1). At this point, the CPU 70 heats the transfer roller 33, and keeps the temperature in a state of about 185°. Then, when there is the information recording data, the card K is transported to the information recording section A from the reverse unit F, and undergoes information recording processing (St2). When there is no information recording data, the processing proceeds to preheating treatment described later.

At this point, in the first transfer section of the image formation section B, by bringing the transfer film 46 and ink ribbon 41 into press-contact with each other with the thermal head 40 and platen roller 45 to heat, an image is formed on the transfer film 46. At this point, to overlay each color of the ink ribbon 41 in an image formation region of the transfer film 46 to print, the transfer film 46 is transported to reciprocate by the supply spool 47, wind spool 48 and carry roller 49.

The card K on which the information recording processing is finished undergoes preheating treatment of the card front end during the first transfer processing. First, the environmental temperature is detected with the thermistor T (St3). By this means, the extent to which the card is cold and the extent to which the card is preheated are judged. In addition, the environmental temperature is referred to also to determine the wind torque (peeling tension) by the supply spool 47 to peel off the transfer film 46 from the card K subjected to transfer. Subsequently, it is determined whether the card surface to transfer from now is the frontside or the backside (St4). This is because the card temperature differs between the time of frontside transfer and the time of backside transfer even at the same environmental temperature, and as a result, the temperature of the adhesion surface between the card K and the transfer film 46 differs, and therefore, such a determination is made. Accordingly, in the case of frontside transfer, the preheating amount and peeling tension for frontside transfer are determined (St5), and in the case of backside transfer, the preheating amount and peeling tension for backside transfer are determined (St6). In this Embodiment, in the case where the environmental temperature is high (room temperature or more) even in frontside transfer and at the time of backside transfer, it is not necessary to perform preheating treatment, and the preheating amount is set at "0" (preheating time 0 sec.).

Next, it is determined whether or not the determined preheating amount is "0" (St7), and in the case where the preheating treatment is not required, the card K is caused to wait in a card waiting section comprised of the transport rollers 29, 30 until the first transfer processing is finished. When it is determined that the preheating treatment is required, the preheating time and preheating region is loaded from the ROM 71 corresponding to the detected environmental temperature, and the card is transported to the preheating position (St8).

In the case where the environmental temperature is a low temperature, since preheating is performed only on the card front end, it is not necessary to shift the card K during preheating. In the case of extremely low temperature, since the preheating region is wide, the card K is shifted in position inside the preheating region, and when necessary, is transported to reciprocate (St9). Subsequently, it is determined whether to reach the preheating time (St10), and when reaching the preheating time, the card K is fed to the transfer start position for second transfer processing (St11) to finish the preheating treatment.

Then, it is determined whether or not first transfer is finished (St12), and when first transfer is finished, second transfer processing is performed (St13). At this time, in peeling the transfer film 46 from the card K subjected to transfer, peeling is performed by the peeling tension determined in St5 or St6. In addition, for feeding of the card K and transfer film 46, it is desirable to perform feeding of the card K after performing feeding of the transfer film 46, and therefore, when the preheating treatment is finished early, feeding of the card K is performed after once performing feeding of the transfer film 46. After the second transfer processing, it is determined whether or not backside transfer is required (St14), and when backside transfer is required, the processing flow returns to St6. When transfer is already finished up to backside transfer or when transfer is performed only on the frontside and is finished, the card is discharged (St15), and the card issue processing is finished.

Figure 12A:
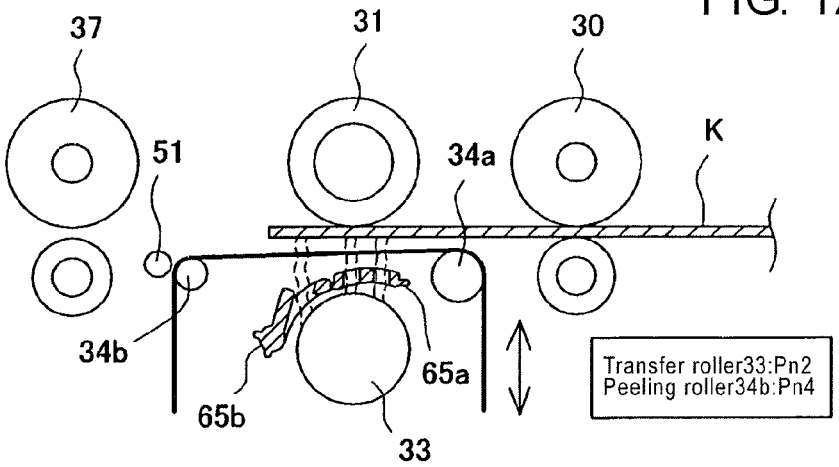
FIGS. 12A to 12C are operation explanatory views at the time of card preheating to second transfer processing.

Herein, operation of from the preheating treatment to the second transfer processing will be described according to FIGS. 12A to 12C and FIGS. 13A to 13C. FIG. 12A illustrates a state in which the card K is preheated during the first transfer processing. At this point, the transfer roller 33, peeling roller 34*b* and support pin 51 are positioned in the retracted positions (Pn2, Pn4). At this point, although the open/close cover 65 of the transfer roller 33 is in the close position, since the openings 65*c* are provided in the open/close cover 65, it is possible to convey heat of the transfer roller 33 to the preheating region of the card K. In addition, since the transfer film 46 is transported to reciprocate in the first transfer processing, it does not happen that only a part of the transfer film 46 is excessively heated.

Figure 12B:
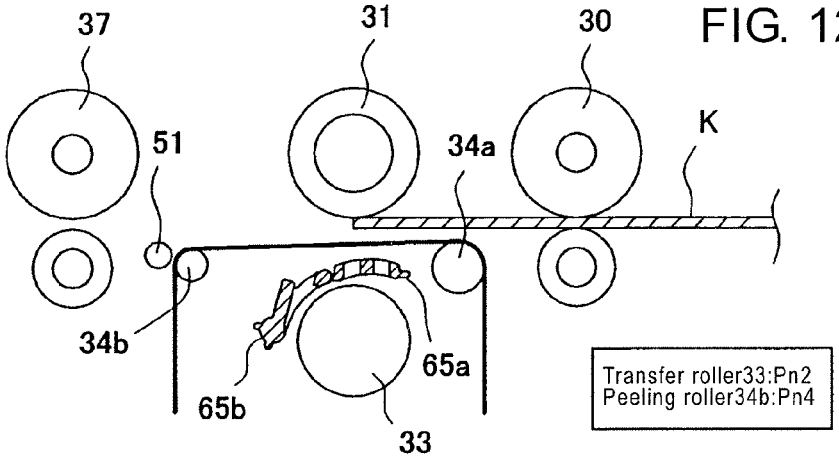

When the first transfer processing is finished, the transfer film 46 and card K are respectively fed to start positions of second transfer (FIG. 12B). Also at this point, the transfer roller 33, peeling roller 34*b* and support pin 51 are kept in the retracted positions. In addition, feeding of the transfer film 46 is performed by controlling rotation of the DC motor Mr2 coupled to the supply spool 47, and feeding of the card K is performed by controlling rotation of the stepping motor. Since an overrun amount is not certain in halting the DC motor, after first feeding the transfer film 46, the stepping motor is driven corresponding to the distance provided with the overrun amount of the DC motor, and feeding of the card K is performed. By this means, the feeding positions of the transfer film 46 and card K are made correct. In addition, the overrun amount of the DC motor is detected by an encoder (not shown) that detects a rotation amount of the supply spool 47 and is calculated.

Figure 12C:
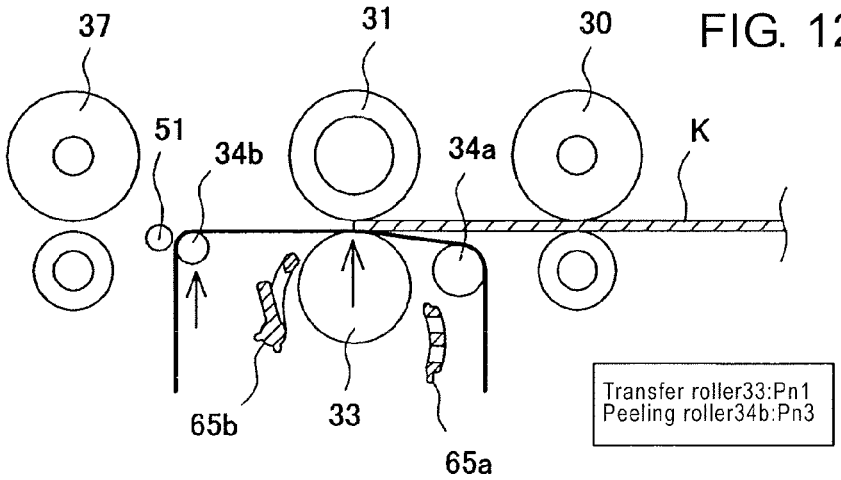

When feeding of the transfer film 46 and card K is finished, the control CPU 70 rotates the shift motor MS a predetermined angle (for example, 180°). By this means, the shift cam 64*c* shifts the transfer roller 33 from the retracted position (Pn2) to the actuation position (Pn1), the drive cam 66*c* shifts the bracket 69, and the peeling roller 34*b* and support pin 51 are thereby shifted from the retracted position (Pn4) to the actuation position (Pn3). Then, the state of FIG. 12C is made, and the image transfer processing is started.

Figure 13A:
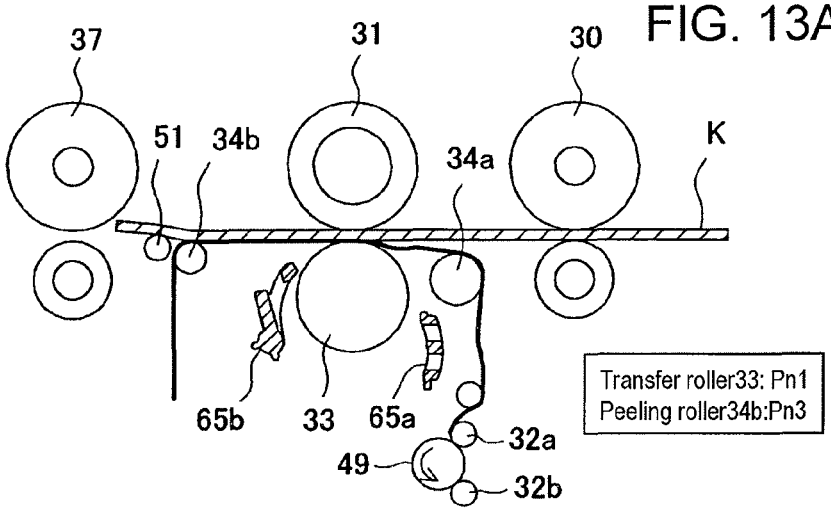
FIGS. 13A to 13C are operation explanatory views at the time of second transfer processing (continued from FIG. 12C)
Figure 13B:
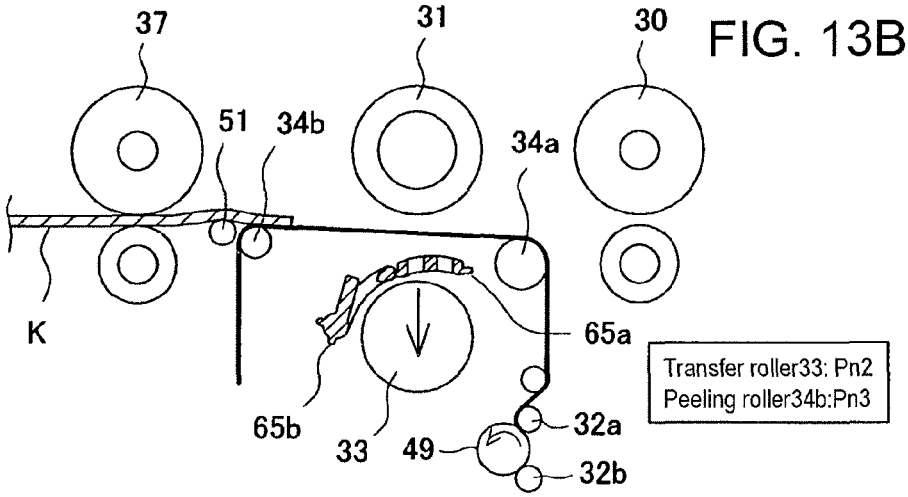

With proceeding of the image transfer process, when the front end of the card K arrives at the peeling roller 34*b*, the transfer film 46 is peeled off from the card K. The card front end is acted upon by the force for pulling in the travel direction of the transfer film 46, but is supported by the support pin 51 disposed just behind the peeling roller 34*b*, and therefore, the posture of the card is stable (FIG. 13A). During the image transfer processing, it is necessary to sag the transfer film 46 on the upstream side from the card rear end, the rotation amounts of the card transport rollers 30, 37, transfer platen 31 and carry roller 49 are controlled, and the feed amount of the transfer film 46 is made larger than the transport amount of the card K so as not to impose the back tension.

Next, at timing at which the card rear end passes through the transfer roller 33 (calculated from the number of revolutions of the transport roller 30 or beforehand set timer time), the control CPU 70 rotates the shift motor MS the predetermined angle θ1. Then, the transfer roller 33 shifts from the actuation position (Pn1) of the state of FIG. 13A to the retracted position (Pn2) of FIG. 13B. At this point, the peeling roller 34*b* and support pin 51 are held in the actuation state (Pn3) for peeling off the transfer film 46 from the card. At this point, although the card rear end is released from the nip of the transfer roller 33 and transfer platen 31, since the support pin 51 is in a position slightly higher than the peeling roller 34*b*, the card rear end upstream of the peeling roller 34*b* is in a state of being pressed against the transfer film 46, and does not come off at some midpoint. At this point, the transfer film feed amount by the carry roller 49 is decreased to eliminate the sag of the transfer film 46.

Figure 13C:
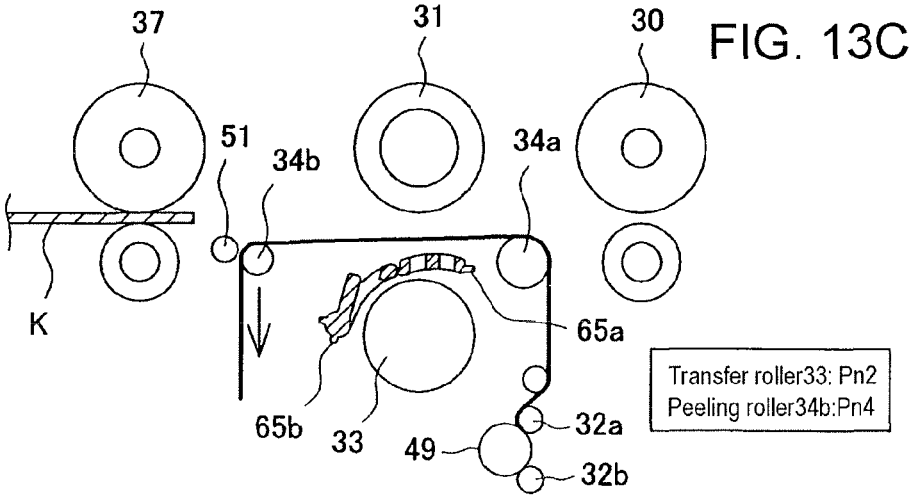

Subsequently, at timing at which the card rear end passes through at least the peeling roller 34*b* (calculated from the number of revolutions of the transport roller 30 or beforehand set timer time), the control CPU 70 rotates again the shift motor MS the predetermined angle θ2. By this means, the peeling roller 34*b* and support pin 51 shift from the actuation position (Pn3) to the retracted position (Pn4) (FIG. 13C). At this point, the transfer roller 33 is held in the retracted position (Pn2). In addition, the shift cam 64*c* and drive cam 66*c* shift to home positions HP after finish of image formation operation.

Subsequently, the decurl mechanism 36 corrects curl of the card. In the case of printing on both surfaces of the card, the card K is transported toward the reverse unit F to reverse the card K, and the same transfer processing is applied also to the card backside. In the case of finishing with one-side printing, the card K is discharged to the card storage section D without change. A series of operation is thus finished. In addition, in performing the transfer processing on the card backside successively, since the card is warmed when the transfer processing is performed on the card frontside, the preheating treatment is not performed.

Figure 16:
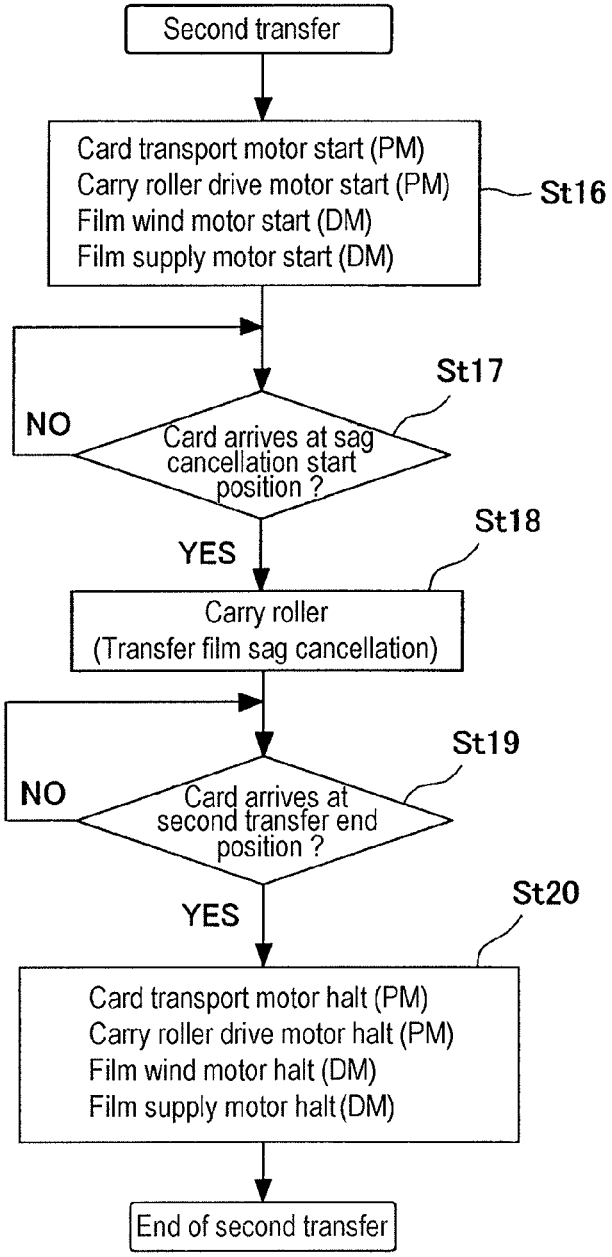
FIG. 16 is a diagram illustrating a processing flow on transport of a card and transfer film in the second transfer processing.

Described herein is a processing flow for transport of the card K and transfer film 46 in the second transfer processing (FIG. 16). First, when the second transfer processing is started, started are the card transport motor (stepping motor) for driving the card transport rollers 30, 37 and transfer platen 31, the stepping motor for driving the carry roller 49, and the DC motors for respectively driving the supply spool 47 and wind spool 48 (St16). Subsequently, the transfer processing proceeds, it is determined whether to reach a sag cancellation start position of the transfer film 46 (St17), and when reaching, the drive amount of the carry roller 49 is reduced in velocity (St18). Subsequently, peeling is finished, it is determined whether the card K arrives at a second transfer end position (St19), and when the card K arrives, respective motors are halted (St20). The second transfer processing is thus finished.

<Effect and Others>

In this transfer apparatus of this Embodiment, the support pin 51 is provided downstream of the peeling roller 34*b*, and therefore, the following effects are exhibited.

The support pin 51 supports the card front end immediately after peeling off the transfer film 46, the posture of the card front is thereby not changed even when the card front end is pulled in the travel direction of the transfer film 46, and the peeling position of the transfer film 46 is thus stabilized. Further, since the posture on the card front end side is stabilized, the force does not act in the direction in which the card rear end side before the peeling roller 34*b* separates from the transfer film 46, and therefore, the transfer film 46 is not peeled off on the upstream side of the peeling roller 34*b*.

Further, the card contact point of the peeling roller 34*b* in the actuation position Pn3 is offset at least to the transfer platen 31 side (card side) from the straight line Ln1 joining the card contact point of the transfer roller 33 in the actuation position Pn1 and the card contact point of the transfer roller 37 (on the transfer roller 33 side), and therefore, the transfer film 46 does not come off before the card K arrives at the peeling roller 34*b*. Further, the card contact point of the support pin 51 in the actuation position Pn3 is offset at least to the transfer platen side (card side) from the straight line Ln2 joining the card contact point of the transfer roller 33 in the actuation position Pn1 and the card contact point of the peeling roller 34*b*, and therefore, the posture of the card front end passing through the peeling roller 34*b* is not changed in the transfer film travel direction.

Furthermore, the peeling roller 34*b* and support pin 51 shift to the actuation position Pn3 only at the time of second transfer processing, while retracting to the retracted position Pn4 except such time, and therefore, do not interfere with transport of the card K at the time of normal transport of the card K. At this point, since retract timing of the transfer roller 33, peeling roller 34*b* and support pin 51 is made different as described above, it is possible to obtain the effects of reductions in thermal damage to the transfer film 46 and stabilization of the peeling position of the transfer film 46.

Still furthermore, the peeling roller 34*b* and support pin 51 are held by the same bracket 69, and by shifting the bracket 69, shift to the actuation position Pn3 and retracted position Pn4. Accordingly, the peeling roller 34 and support pin 51 are capable of maintaining the certain position relationship. Further, the bracket 69 is provided in the film cassette 50, the peeling roller 34*b* and support pin 51 are configured to be able to separate with the film cassette 50 removed from the apparatus housing 1, and replacement of the transfer film 46 is thereby ease.

Moreover, the card K is preheated when the environmental temperature is low, and it is thereby possible to suppress the transfer failure due to whitening. In this case, since preheating is performed using heat of the transfer roller 33, it is not necessary to provide another heat source for preheating, and it is there by possible to suppress the cost. Further, since the openings 65*c* are provided in the open/close cover 65 of the transfer roller 33, it is possible to ensure safety at the time of work of jam clearing and the like by a user, and it is further possible to convey heat of the transfer roller 33 to the card by the openings 65*c*.

Further, by preheating only the card front end, it is possible to suppress whitening that occurs due to the fact that the card front end is unstable from the support pin 51 to the transport roller 37, and it is also possible to suppress the occurrence of peeling residues caused by warming the entire card. In addition, by controlling the region and time of card preheating corresponding to the environmental temperature, it is possible to suppress the transfer failure due to whitening and the occurrence of peeling residues.

Furthermore, the transfer film 46 is shifted in position during card preheating, and therefore, a part of the transfer film 46 is not excessively heated. Still furthermore, in this Embodiment, since card preheating is performed parallel during first transfer, it is possible to enhance transfer performance without decreasing productivity.

Figure 18:
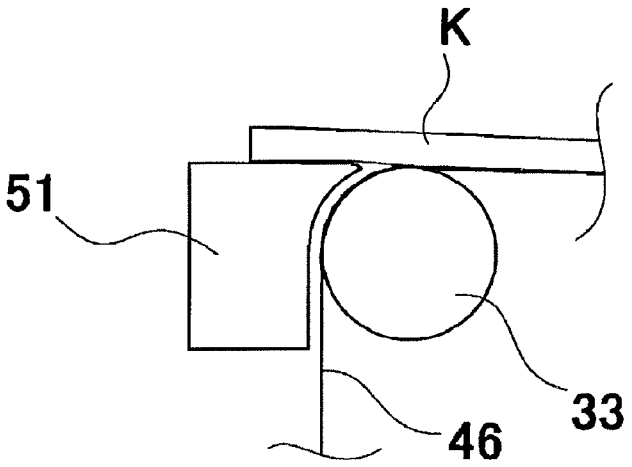
FIG. 18 is a view illustrating a modification of the support member.
Figure 19:
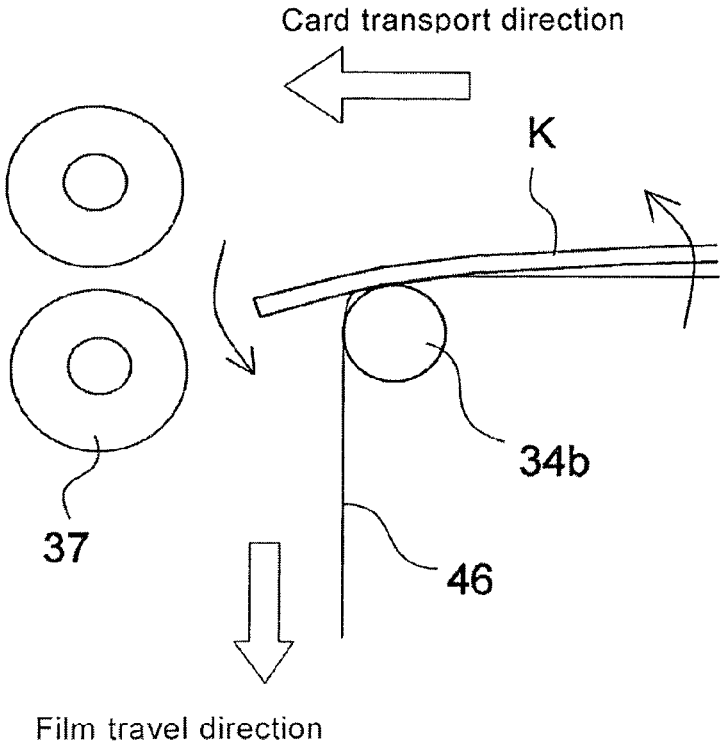
FIG. 19 is a view illustrating a card posture after peeling off a transfer film in conventional image transfer.

In addition, the example is shown that the support pin 51 of this Embodiment is comprised of a circular metal shaft, but it is not necessary to limit thereto, and any configuration is available that holds strength capable of supporting the card K and that is brought close to the peeling roller 34*b*. For example, the shape as shown in FIG. 18 is capable of bringing the support member 51 closer to the peeling roller 34*b*. In this case, it is desirable that the portion hit by the card front end is tapered to receive the card front end.

Further, in this Embodiment, three patterns are shown as the example of controlling the preheating region and preheating time of the card K, but the invention is not limited thereto, and fine thresholds may be set. In this case, a table of preheating regions and preheating time corresponding to environmental temperatures may be stored in the ROM 71 to read a value corresponding to an environmental temperature. Conversely, only whether or not to perform the preheating treatment may be selected corresponding to an environmental temperature. Further, the aspect is shown in which the preheating treatment is not performed in the case of backside transfer, but it is not necessary to always set the preheating amount at "0", and a preheating amount smaller than in frontside transfer may be set. In this case, it is desirable to set a preheating amount of an extent that peeling residues do not occur.

Furthermore, when the preheating time is increased, there is the case that the time is longer than the processing time of first transfer, and for example, it may be configured that a user is capable of selecting a high-speed priority mode or image quality priority mode. At this point, in the case of the high-speed priority mode, the preheating time may be controlled to within the processing time of first transfer even when whitening occurs slightly, and in the case of the image quality priority mode, preheating may be performed sufficiently even when the treatment time is longer so as to obtain neat printed materials.

Still furthermore, in this Embodiment, the intensity of the peeling tension to peel off the transfer film 46 from the card K is changed corresponding to the temperature of the card K i.e. the temperature of the adhesion surface between the card K and the transfer film 46. Accordingly, it is possible to perform peeling with a suitable peeling tension on the transfer film 46 that tends to peel when the temperature is high, and it is thereby possible to suppress the occurrence of peeling residues.

Further, in the second transfer processing, by controlling the transport amount of the card K and the feed amount of the transfer film 46, the rotation amount of the carry roller 49 is set to be large not to apply the back tension during the transfer processing, and is decreased for a period during which the transfer processing is finished and the card rear end arrives at the peeling roller 34*b*, and the sag of the transfer film 46 is thereby eliminated. Accordingly, image displacement due to the back tension does not occur during transfer, and thereafter, it is also possible to perform peeling with excellence. At this point, when the back tension is applied excessively after finish of transfer, the transfer film 46 peels off before the card rear end arrives at the peeling position, peeling residues occur due to early peeling, and therefore, it is desirable to control the card transport motor and the carry roller drive motor so as to eliminate the sag.

Moreover, this Embodiment shows the configuration of the intermediate transfer printer which forms an image on the intermediate transfer film 46 in the first transfer section and transfers the image to the card K in the second transfer section, and in the configuration without the first transfer processing such as a laminator apparatus, it is desirable to preheat the card while shifting the transfer film. Also in this case, corresponding to choice for giving priority to the treatment velocity or to the image quality, whether or not to perform preheating may be determined or the region and time of preheating may be controlled. Further, in performing card preheating, instead of always shifting the transfer film during preheating, by performing preheating in a state in which the used portion of the transfer film is positioned in between the transfer roller and the transfer platen, unused portions of the transfer film do not sustain damage or a part is not excessively heated.

In addition, this Embodiment discloses the aspect of indirectly detecting the card temperature by detecting the environmental temperature outside the apparatus with the thermistor T, or indirectly detecting the card temperature by determining whether or not transfer is backside transfer subsequent to frontside transfer. Moreover, the temperature may be directly detected by contacting the card K inside the apparatus, or the temperature of the card K may be detected using infrared rays.

In addition, this application claims priority from Japanese Patent Application No. 2013-033862 incorporated herein by reference.

The invention claimed is:

1. A transfer apparatus for transferring an image formed on a transfer film to a recording medium, comprising:

an image transfer section having a heating member and a transfer platen, the heating member shifting between an actuation position in which the heating member is urged toward the transfer platen adapted to press the transfer film to the recording medium for transferring the image onto the recording medium, and a retracted position in which the heating member retracts from the transfer platen for preheating the recording medium;

a transfer film transport device for transporting the transfer film to the image transfer section;

a recording medium transport device for transporting the recording medium to the image transfer section;

a control device for determining a preheating amount on the recording medium by the heating member, wherein the control device changes the preheating amount corresponding to a temperature of the recording medium, and the control device is configured to control the recording medium transport device to transport the recording medium to a preheating position in which the heating member is disposed at the retracted position in order to preheat a preheating region of the recording medium between the transfer platen and the heating member, and after preheating the preheating region of the recording medium, to transport the recording medium to a transfer start position to start transferring the image onto the recording medium.

2. The transfer apparatus according to claim 1, further comprising:

a reverse unit that reverses a side of the recording medium subjected to transfer, wherein in reversing the recording medium in the reverse unit after front side transfer of the recording medium and transferring to a backside, the control device judges that the temperature of the recording medium is high, and makes a preheating amount less than that of the front side transfer.

3. The transfer apparatus according to claim 2, further comprising:

an environmental temperature detecting sensor that detects an outside air temperature outside the apparatus, wherein the control device judges a temperature of the recording medium using the outside air temperature detected by the environmental temperature detecting sensor in the front side transfer to determine the preheating amount by the heating member, and in transferring to the backside after the front side transfer, makes the preheating amount less than that of the front side transfer.

4. The transfer apparatus according to claim 1, further comprising:

an environmental temperature detecting sensor that detects an outside air temperature outside the apparatus, wherein the control device judges a temperature of the recording medium using the outside air temperature detected by the environmental temperature detecting sensor to determine the preheating amount by the heating member.

5. The transfer apparatus according to claim 4, wherein the environmental temperature detecting sensor is disposed inside a duct that draws outside air into the transfer apparatus.

6. The transfer apparatus according to claim 1, wherein the control device changes time for preheating the recording medium corresponding to the temperature of the recording medium.

7. The transfer apparatus according to claim 1, wherein the control device controls the recording medium transport device to transport the recording medium so that a front end portion of the recording medium is positioned downstream the heating member to preheat the recording medium.

8. The transfer apparatus according to claim 1, further comprising a cover facing the transfer platen to cover a surface of the heating member when the heating member is in the retracted position, and retracting from the surface of the heating member facing the transfer platen to allow the heating member to press the transfer film to the recording medium when the heating member is in the actuation position, wherein the cover comprises openings to convey heat of the heating member to the recording medium at the preheating position.

9. The transfer apparatus according to claim 8, wherein the cover further comprises a first cover and a second cover arranged downstream the first cover, and the first and second covers are arranged to contact each other when the heating member is disposed at the retracted position to cover the surface of the heating member, and to separate from each other when the heating member is disposed at the actuation position to allow the heating member to press the transfer film to the recording medium.

10. A transfer method for press-contacting a transfer film between a heating member and a transfer platen arranged in an image transfer section and transferring an image formed on the transfer film to a recording medium, comprising:

a medium temperature detecting step of detecting a temperature of the recording medium by detecting an environmental temperature;

a preheating amount determining step of determining a preheating amount on a front side of the recording medium corresponding to the temperature of the recording medium detected in the medium temperature detecting step, in a case when the detected environmental temperature is lower than a predetermined room temperature, determining the preheating amount on the front side of the recording medium to correspond to the detected environmental temperature, and a preheat step of preheating the front side of the recording medium corresponding to the preheating amount determined in the preheating amount determining step by shifting the heating member to the retracted position to separate from the transfer platen and transporting the recording medium to a preheating position to preheat a preheating region on the front side of the recording medium between the transfer platen and the heating member, and after preheating the preheating region on the front side of the recording medium, transporting the recording medium to a transfer start position to start transferring the image onto the front side of the recording medium, or in a case when the detected environmental temperature is equal to or higher than the predetermined room temperature, determining the preheating amount on the front side of the recording medium to be zero, and transporting the recording medium to the transfer start position to start transferring the image onto the front side of the recording medium; and a transfer step of transferring the image on the transfer film onto the front side of the recording medium.

11. The transfer method according to claim 10, wherein in the preheat step, the recording medium is transported so that a front end portion of the recording medium is positioned downstream than the heating member to preheat the recording medium.

12. The transfer method according to claim 10, wherein the recording medium is reversed from the front side to a backside for preheating the backside of the recording medium subsequent to transferring the image onto the front side of the recording medium, and the backside of the recording medium is preheated for transferring image onto the backside of the recording medium.

13. The transfer method according to claim 10, wherein the preheating amount is adjusted by changing the preheating region of the recording medium, a preheating time of preheating the recording medium, or the preheating region and the preheating time.

14. The transfer method according to claim 10, further comprising:

another preheating amount determining step of determining a preheating amount on a backside of the recording medium for transferring the image onto the backside of the recording medium subsequent to transferring the image onto the front side of the recording medium, in a case when a predetermined time has elapsed after transferring the image onto the front side of the recording medium, determining the preheating amount on the backside of the recording medium to be lower than that of the front side of the recording medium, another preheat step of preheating the backside of the recording medium corresponding to the preheating amount determined in the another preheating amount determining step by shifting the heating member to the retracted position to separate from the transfer platen and transporting the recording medium to the preheating position to preheat a preheating region on the backside of the recording medium, and after preheating the preheating region on the backside of the recording medium, transporting the recording medium to the transfer start position to start transferring the image onto the backside of the recording medium, or in a case when a time less than the predetermined time has elapsed after transferring the image onto the front side of the recording medium, determining the preheating amount on the backside of the recording medium to be zero, and transporting the recording medium to the transfer start position to start transferring the image onto the backside of the recording medium; and another transfer step of transferring the image on the transfer film onto the backside of the recording medium.

15. The transfer method according to claim 14, further comprising a reversing step of reversing the recording medium from the front side to the backside for transferring the image onto the backside of the recording medium subsequent to the transfer step.

16. The transfer method according to claim 15, wherein in the preheating amount determining step, the preheating amount is adjusted by changing the preheating region of the recording medium, a preheating time of preheating the recording medium, or the preheating region and the preheating time, or when the detected environmental temperature is between the predetermined room temperature and a predetermined temperature lower than the predetermined room temperature, the preheating region of the recording medium is determined to be a front end portion of the recording medium, and when the detected environmental temperature is lower than the predetermined temperature, the preheating region of the recording medium is determined to be a region from the front end portion to a portion near a rear end portion of the recording medium.

17. The transfer method according to claim 16, wherein the preheating amount determining step further comprises determining a first preheating time when the detected environmental temperature is determined to be the temperature lower than the predetermined temperature, and determining a second preheating time when the detected environmental temperature is determined to be the temperature between the predetermined room temperature and the predetermined temperature; and the first preheating time is longer than the second preheating time.

18. The transfer method according to claim 17, wherein the predetermined room temperature is 25° C. and higher.

19. A transfer method for press-contacting a transfer film between a heating member and a transfer platen arranged in an image transfer section and transferring an image formed on the transfer film to a recording medium, comprising:

an environmental temperature detecting step of detecting an environmental temperature outside an apparatus;

a transfer surface determining step of determining whether a transfer surface of the recording medium is a front side or a backside subsequent to the transfer of the front side;

in a case when the transfer surface of the recording medium is determined to be the front side of the recording medium, a preheating amount determining step of determining a preheating amount on the front side of the recording medium corresponding to the environmental temperature detecting step, when the detected environmental temperature is lower than a predetermined room temperature, determining the preheating amount on the front side of the recording medium to correspond to the detected environmental temperature, and a preheat step of preheating the front side of the recording medium corresponding to the preheating amount determined in the preheating amount determining step by shifting the heating member to the retracted position to separate from the transfer platen and transporting the recording medium to a preheating position to preheat a preheating region on the front side of the recording medium between the transfer platen and the heating member, and after preheating the preheating region on the front side of the recording medium, transporting the recording medium to a transfer start position to start transferring the image onto the front side of the recording medium, or when the detected environmental temperature is equal to or higher than the predetermined room temperature, determining the preheating amount on the front side of the recording medium to be zero and transporting the recording medium to the transfer start position to start transferring the image onto the front side of the recording medium; and a transfer step of transferring the image on the transfer film onto the front side of the recording medium, and in a case when the transfer surface of the recording medium is determined to be the backside of the recording medium subsequent to transferring the image onto the front side of the recording medium, another preheating amount determining step of determining a preheating amount on the backside of the recording medium, when a predetermined time has elapsed after transferring the image onto the front side of the recording medium, determining the preheating amount to be lower than that of the front side of the recording medium, and another preheat step of preheating the recording medium corresponding to the preheating amount determined in the another preheating amount determining step by shifting the heating member to the retracted position to separate from the transfer platen and transporting the recording medium to the preheating position to preheat a preheating region on the backside of the recording medium, and after preheating the preheating region on the backside of the recording medium, transporting the recording medium to the transfer start position to start transferring the image onto the backside of the recording medium, or when a time less than the predetermined time has elapsed after transferring the image onto the front side of the recording medium, determining the preheating amount on the backside of the recording medium to be zero, and transporting the recording medium to the transfer start position to start transferring the image onto the backside of the recording medium; and another transfer step of transferring the image on the transfer film onto the backside of the recording medium.

* * * * *